US011739519B2

(12) United States Patent
Garrels et al.

(10) Patent No.: US 11,739,519 B2
(45) Date of Patent: Aug. 29, 2023

(54) TOILET WITH EFFICIENT WATER FLOW PATH

(71) Applicant: Kohler Co., Kohler, WI (US)

(72) Inventors: Clayton C. Garrels, Kohler, WI (US); Jeremiah J. Rauwerdink, Sheboygan, WI (US); Randal S. Graskamp, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 168 days.

(21) Appl. No.: 17/191,070

(22) Filed: Mar. 3, 2021

(65) Prior Publication Data

US 2021/0189709 A1 Jun. 24, 2021

Related U.S. Application Data

(62) Division of application No. 16/509,303, filed on Jul. 11, 2019, now Pat. No. 10,961,694.

(60) Provisional application No. 62/696,880, filed on Jul. 12, 2018.

(51) Int. Cl.
*E03D 11/18* (2006.01)
*E03D 3/00* (2006.01)

(52) U.S. Cl.
CPC ..... *E03D 11/18* (2013.01); *E03D 3/00* (2013.01); *E03D 2201/30* (2013.01)

(58) Field of Classification Search
CPC ..... E03D 11/18; E03D 3/00; E03D 2201/30
USPC ..... 4/422
See application file for complete search history.

(56) References Cited

U.S. PATENT DOCUMENTS 1,111,747 A 9/1914 Haas
1,142,092 A * 6/1915 Haas ..... E03D 11/13 4/422
1,928,717 A * 10/1933 Campus ..... E03D 11/13 4/422
1,998,861 A 4/1935 Campus
2,075,030 A * 3/1937 Duncan, Jr. ..... E03D 11/13 4/422

(Continued)

FOREIGN PATENT DOCUMENTS

CN 101970768 A 2/2011
CN 104854282 A 8/2015

(Continued)

OTHER PUBLICATIONS

International Search Report and Written Opinion dated Sep. 27, 2019 re application No. PCT/US19/41450; 4 pages.

(Continued)

*Primary Examiner* — Christine J Skubinna
(74) *Attorney, Agent, or Firm* — Lempia Summerfield Katz LLC

(57) ABSTRACT

A toilet includes a bowl with a sump and a trapway connecting the sump to an outlet of the toilet. The trapway has a zeta shape and is configured to induce a siphon which provides pressure to suction waste water from the bowl during a flush cycle. A trapway supply conduit is connected to the trapway in a tangential orientation to an upleg region of the trapway. The trapway supply conduit supplies water to the trapway, which follows a contour of the inner surface of the trapway supply conduit and continues in the same direction into the upleg region of the trapway by relying on a fluid flow to follow the curve of a convex surface placed proximate to the flow.

20 Claims, 15 Drawing Sheets

(56) References Cited

U.S. PATENT DOCUMENTS

| | | | | |
|---|---|---|---|---|
| 2,121,940 | A | 6/1938 | Wolff | |
| 2,126,448 | A | 8/1938 | Campus | |
| 3,131,402 | A | 5/1964 | Roberts | |
| 3,224,013 | A | 12/1965 | Tubbs | |
| 3,843,978 | A * | 10/1974 | Ragot | E03D 9/10 4/DIG. 3 |
| 3,968,525 | A | 7/1976 | Alexander | |
| 4,086,668 | A | 5/1978 | Tubbs | |
| 4,310,934 | A | 1/1982 | Hennessy et al. | |
| 4,404,696 | A * | 9/1983 | Heinze | E03D 11/06 4/420 |
| 4,561,131 | A | 12/1985 | David | |
| 5,046,201 | A | 9/1991 | Steinhardt et al. | |
| 5,052,060 | A | 10/1991 | Makita | |
| 5,067,181 | A * | 11/1991 | Hafner | E03D 5/00 4/430 |
| 5,133,089 | A | 7/1992 | Tsutsui et al. | |
| 5,832,546 | A | 11/1998 | Inch | |
| 5,906,009 | A * | 5/1999 | Sakar | E03D 9/05 4/216 |
| 6,247,193 | B1 * | 6/2001 | Riepl | E03D 11/06 4/421 |
| 6,292,956 | B1 | 9/2001 | Kayahara | |
| 6,367,095 | B2 | 4/2002 | Hubatka et al. | |
| 6,467,101 | B1 | 10/2002 | Artola | |
| 6,470,505 | B1 | 10/2002 | Boisvert | |
| 6,651,266 | B1 | 11/2003 | Liu | |
| 8,082,605 | B2 | 12/2011 | Andreiu | |
| 8,316,475 | B2 | 11/2012 | Grover | |
| 8,424,126 | B2 | 4/2013 | Nguyen | |
| 8,793,818 | B2 | 8/2014 | Inglin | |
| 9,737,181 | B1 | 8/2017 | Hall | |
| 9,845,593 | B2 | 12/2017 | Hall et al. | |
| 9,939,307 | B2 | 4/2018 | Hall et al. | |
| 9,957,705 | B2 * | 5/2018 | Hall | A61B 10/0038 |
| 9,986,879 | B2 | 6/2018 | Hall et al. | |
| 11,180,910 | B2 * | 11/2021 | Ahola | E03D 11/02 |
| 2007/0061955 | A1 | 3/2007 | Asada et al. | |
| 2007/0113331 | A1 | 5/2007 | Prokopenko | |
| 2008/0271234 | A1 | 11/2008 | Okada et al. | |
| 2009/0241250 | A1 | 10/2009 | Grover | |
| 2010/0125940 | A1 | 5/2010 | Sigler | |
| 2010/0251471 | A1 * | 10/2010 | Cadavid González et al. | E03D 11/08 4/378 |
| 2011/0289669 | A1 | 12/2011 | Hennessy | |
| 2012/0174310 | A1 | 7/2012 | Grover et al. | |
| 2012/0260415 | A1 | 10/2012 | Chi | |
| 2015/0322660 | A1 | 11/2015 | Conrad et al. | |
| 2015/0376883 | A1 | 12/2015 | Garrels et al. | |
| 2016/0356032 | A1 | 12/2016 | Hennessy et al. | |
| 2017/0058500 | A1 | 3/2017 | Garrels et al. | |
| 2017/0121955 | A1 | 5/2017 | Hall et al. | |
| 2017/0198466 | A1 | 7/2017 | Hall et al. | |
| 2017/0247871 | A1 * | 8/2017 | Mukerji | E03D 5/10 |
| 2017/0314249 | A1 | 11/2017 | Stack | |
| 2018/0073231 | A1 | 3/2018 | Smith et al. | |
| 2020/0018055 | A1 * | 1/2020 | Garrels | E03D 3/00 |
| 2020/0362548 | A1 * | 11/2020 | Garrels | E03D 11/02 |

FOREIGN PATENT DOCUMENTS

| | | | |
|---|---|---|---|
| CN | 205530564 | U | 8/2016 |
| EP | 0039521 | A2 | 11/1981 |
| JP | 2001123511 | A | 5/2001 |
| KR | 101371180 | B1 | 3/2014 |
| WO | 1999027203 | A1 | 6/1999 |
| WO | 2008024005 | A3 | 4/2008 |
| WO | 2017132175 | A1 | 8/2017 |

OTHER PUBLICATIONS

Chinese Office Action from Application No. 201980057799.9, dated Jan. 11, 2022, 9 pages (including English Summary).

Chinese Office Action from Chinese Patent Application No. 201980057799.9, dated Oct. 24, 2022, 9 pages. (including English summary).

* cited by examiner

TOILET WITH EFFICIENT WATER FLOW PATH

CROSS-REFERENCE TO RELATED PATENT APPLICATION

This application is a Divisional of U.S. patent application Ser. No. 16/509,303 filed Jul. 11, 2019, which claims priority to and the benefit of U.S. Provisional Patent Application No. 62/696,880, filed Jul. 12, 2018. The entire disclosures of the foregoing applications are incorporated herein by reference.

BACKGROUND

The present application relates generally to toilets. More specifically, the present application relates to tankless toilets that use a siphon effect to produce a flushing action without requiring the use of a pump or pressure vessel. Additionally, the present application relates to toilets having efficient water flow paths and hybrid flush engines, which utilize water supplied to different portions of the toilet from each of a tank and line pressure.

In a conventional toilet, a water inlet passage connects a tank to both a rim and a sump for introducing water to the bowl during a flush sequence. A trapway extends downstream from the sump for evacuating the contents from the bowl. In the conventional toilet, the water inlet passage and the trapway each include a plurality of inflection points. It should be understood that an inflection point in a conduit carrying fluid causes the fluid to change direction, which in turn generates turbulence and increases resistance in the flow. Further, as fluid flows through a conduit such as the inlet passage or the trapway, contact with the surface of the conduit causes skin friction (i.e., boundary layer drag), resulting in energy loss in the fluid. As a result, additional water is required during a flush sequence to overcome the energy loss due to the formation of turbulence and friction losses as water flows through the inlet passage and trapway of a toilet.

A conventional residential toilet also includes a tank, which provides water to both the rim and the sump through the water inlet passage. Water is supplied to the tank from a water supply line to refill the tank. This configuration makes it difficult to design a toilet to ensure that there is sufficient water to cause a siphon to form in the trapway while reserving enough water for effective wash-down of the toilet bowl to remove any remaining residue.

It would therefore be advantageous to provide a toilet that reduces the overall length of the inlet passage and trapway as well as the number of turns in each of the inlet passage and trapway in order to reduce the volume of water required to effectively flush the toilet. It would further be advantageous to provide a toilet with a hybrid flush engine, which provides water to each of the rim and the sump with separate structure and supplies, such that one of the rim and the sump is supplied with water from the tank at a pressure different than line pressure, while the other of the rim and the sump is supplied by water at line pressure.

SUMMARY

At least one embodiment relates to a tankless toilet. The tankless toilet includes a bowl including a sump at a lower portion of the bowl. A zeta shaped trapway extends from the sump to a drain. A trapway supply conduit is coupled to, and in fluid communication with, the trapway at a substantially tangent interface. The trapway supply conduit is configured to receive a flow of water from a household water supply source at a household supply line pressure and to direct the flow of water into the trapway downstream of the sump to prime a siphon within the trapway.

Another embodiment relates to a toilet having a water supply passage, including an inlet passage, a sump channel, and a trapway. The water supply passage includes two turns in a vertical direction.

Another embodiment relates to a toilet with a hybrid flush engine, including a tank fluidly connected to a sump at a lower end of a bowl and a rim water supply line configured to supply line-pressure water directly to a rim channel formed at an upper end of the bowl.

Another embodiment relates to a toilet with a hybrid flush engine, including a tank fluidly connected to a rim channel at an upper end of a bowl and a sump water supply line configured to supply line-pressure water directly to a sump formed at a lower end of the bowl.

Another embodiment relates to a tank assembly, including a tank having an outer surface and a flush handle having an outer surface. The tank and the flush handle form one continuous outer surface when the flush handle is depressed.

Another embodiment relates to a toilet having a rim with at least one rim outlet. The rim outlet outputs a stream of water to the bowl providing at least one of an oscillating flow pattern, a pulsating flow pattern, or an expanding sheet flow pattern.

At least one embodiment relates to a toilet that includes a base and a tank. The base includes a bowl, a rim disposed on the bowl and having a rim channel configured to provide a first supply of water at a line pressure to the bowl through at least one rim outlet for washing an inside of the bowl during a flush sequence, a sump disposed at and fluidly coupled to a bottom of the bowl, a sump channel fluidly connecting the sump to an inlet opening of the base, and a trapway fluidly connecting the sump to an outlet of the base. The tank is fluidly connected to the inlet opening of the base, and the tank is configured to provide a second supply of water at a pressure that is different than the line pressure directly to the sump through the sump channel during the flush sequence to form a siphon in the trapway.

At least one embodiment relates to a tankless toilet having a bowl, a trapway, and a trapway supply conduit. The bowl has a sump in a bottom thereof. The trapway fluidly connects the sump to an outlet of the tankless toilet. The trapway has a zeta shape and is configured to induce a siphon to provide a pressure to suction waste water (e.g., water with waste, water, etc.) from the bowl during a flush cycle. The trapway supply conduit fluidly connects to the trapway in an orientation such that a line of the trapway supply conduit is tangent to a line of the upleg region of the trapway within ±15° and the trapway supply conduit is configured to supply water to the trapway that follows a contour of an inner surface of the trapway supply conduit and continues in the same direction within ±15° into the upleg region of the trapway by relying on a fluid flow to follow the curve of a convex surface placed proximate to the fluid flow.

DETAILED DESCRIPTION

Figure 1:
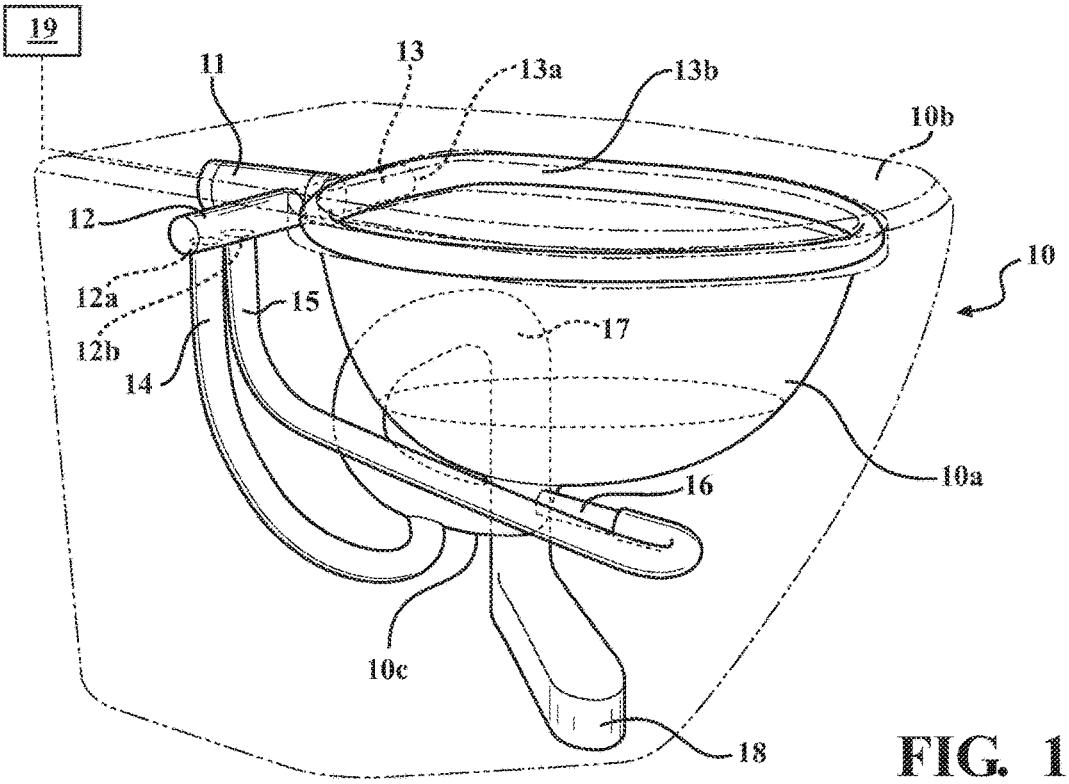
FIG. 1 is a perspective view of a tankless toilet according to an exemplary embodiment.

Generally speaking, a toilet may rely on a siphon effect to induce a flushing action. These toilets typically require the use of a tank or reservoir, which holds a predetermined supply of water and is positioned above the toilet bowl. When a flush is activated, water flows from the tank due to gravity and is led through internal passages provided in the bowl to both rinse the inner surface of the bowl and prime the bowl for siphoning. A jet located in the sump of the bowl primes the siphon by delivering the water from the tank into the sump and a trapway, which provides the necessary suction for evacuating the bowl once the siphon action (e.g., siphoning) is induced. After completion of the flush, the tank is refilled and the sump is filled with additional water to seal the trapway. In these gravity-based designs, a high flow rate of water from the tank into the trapway is necessary to provide sufficient priming for the siphon. For example, typical sump jets need to deliver about 20 to 25 gallons per minute of water into the trapway to prime the siphon. Due to recent trends toward water conservation, however, the significant amount of water usage of these gravity-based designs is undesirable.

In other applications (e.g., commercial use, residential use), a toilet may be provided without a tank (e.g., a "tankless" toilet). These toilet designs typically forego the siphon effect used by gravity-driven toilets and instead incorporate pumps, valves, and/or higher line pressures to produce the necessary flow rate for a flush. In some tankless toilet designs for residential applications, the toilet is connected to the supply line with a relatively large diameter pipe (e.g., about 0.5 inches), but these toilets generally require a high supply line pressure (e.g., about 45 to 50 psi) to effectively remove waste from the bowl. Moreover, these toilets rely on a blow-out action, rather than a siphon effect, to evacuate the bowl. In addition, many residential supply lines are configured to produce lower pressures, some as low as 30 psi, which is insufficient for many of these tankless designs. Additionally, most of these conventional toilet designs include a trapway disposed below the bowl of the toilet for directing waste to a drain. These trapways typically extend rearward from the toilet bowl, then snake downward and forward to an outlet (see FIG. 11), and can enlarge the overall footprint of the toilet. As a result, many of these toilets require a significant amount of space for installation. In addition, these toilets have limited design flexibility due to the large trapway extending from the bowl.

Referring generally to the FIGURES, disclosed herein are several examples of both tankless and tanked toilets. One such tankless toilet utilizes a siphon effect to produce a flushing action without requiring the use of a pump or pressure vessel. According to an exemplary embodiment, the tankless toilet is fluidly connected to a household water supply line, which can provide a flow rate of water at pressures as low as 30 psi. The tankless toilet may also be connected to a gravity based water source, such as a tank located in a wall of a building above the toilet. The tankless toilet(s) described herein can increase the flow rate of water in at least one of the trapway and the sump of the toilet to a flow rate comparable to a conventional gravity-based design (e.g., about 20-25 gpm) to initiate the siphon effect (e.g., prime the siphon, initiate siphoning, etc.). Thus, the tankless toilet may be used with existing residential plumbing with minimal added equipment and needed installation. Moreover, the toilet includes a unique trapway design that provides for a more efficient package, as compared to conventional tankless toilets, thereby providing flexibility for installation in compact settings while increasing aesthetic freedom for the toilet design.

FIG. 1 illustrates a tankless toilet 10 according to an exemplary embodiment. The toilet 10 includes a bowl 10*a* surrounded by a rim 10*b*. Located at the bottom of the bowl 10*a* is a sump 10*c*, which houses a predetermined volume of water to seal a trapway 17 that is configured to induce a siphon effect to provide pressure to suction waste water from the bowl 10*a* when a flush is activated. A trapway supply conduit 14, described in more detail below, is coupled to and in fluid communication with the trapway 17. In addition, a jet 16, described in more detail below, is coupled to and in fluid communication with the sump 10*c*. The trapway supply conduit 14 and the jet 16 can, advantageously, increase the flow rate of water in the trapway 17 and the sump 10*c*, respectively, to a flow rate comparable to a conventional gravity-based design to initiate a siphon effect.

Also shown in FIG. 1, water is supplied to the tankless toilet 10 through a flush supply conduit 12 and a rim supply conduit 13 that are each connected to a main supply conduit 11, such as a normal household water supply line that supplies water at a pressure of about 30 psi from a household water supply source 19. The flush supply conduit 12 branches off into a trapway supply conduit 14, which is configured to direct water to the trapway 17, and a sump supply conduit 15, which is configured to direct water to the sump 10*c*. As shown in FIG. 1, the main supply conduit 11 branches at a T-connector (e.g., a connector having a T-shape) to the flush supply conduit 12 and the rim supply conduit 13. It should be appreciated that the T-connector is not required, and is dependent upon the particular valve design used to control the flow of water between the flush supply conduit 12 and the rim supply conduit 13. For example, the flush supply conduit 12 and the rim supply conduit 13 can both utilize a single valve for controlling flow to the rim jets 13*b*, the sump jet 16, and the trapway 17. The rim supply conduit 13 is configured to supply water to the rim 10*b*, which allows water to flow along an inner surface of the bowl 10*a* through, for example, one or more rim jets 13*b* located at an underside of the rim 10*b*. According to one or more exemplary embodiments, the rim jet 13*b* may have any appropriate cross-sectional shape, such as circular, oval, or any other shape. According to an exemplary embodiment, the rim jet 13*b* is configured to provide a flow of water in the form of a sheet-like layer or laminar flow substantially tangent to the inner surface of the bowl 10*a*. In this manner, the rim jet 13*b* can reduce splashing in the bowl and can permit higher flow rates to clean the inner surface of the bowl, as compared to conventional tankless toilet designs.

Still referring to the embodiment of FIG. 1, the flush supply conduit 12 includes a trapway valve 12*a* and a sump valve 12*b* for controlling the flow of water from the main supply conduit 11 to the trapway supply conduit 14 and the sump supply conduit 15, respectively. Similarly, the rim supply conduit 13 is connected to a rim valve 13*a*, which controls the flow of water from the main supply conduit 11 to the rim supply conduit 13. According to one or more other embodiments, a single multi-port valve is used to control water flow to the trapway supply conduit 14, the sump supply conduit 15, and the rim supply conduit 13. The valve may be electronically controlled by a controller, which may be configured to open and close the valve after predetermined time intervals (see below with reference to FIG. 7). The valve may be opened and closed intermittently to selectively direct water to the trapway 17, the sump 10*a*, and the rim 10*b*, respectively, so as to prime the trapway and to help to move media through the toilet.

Figure 7:
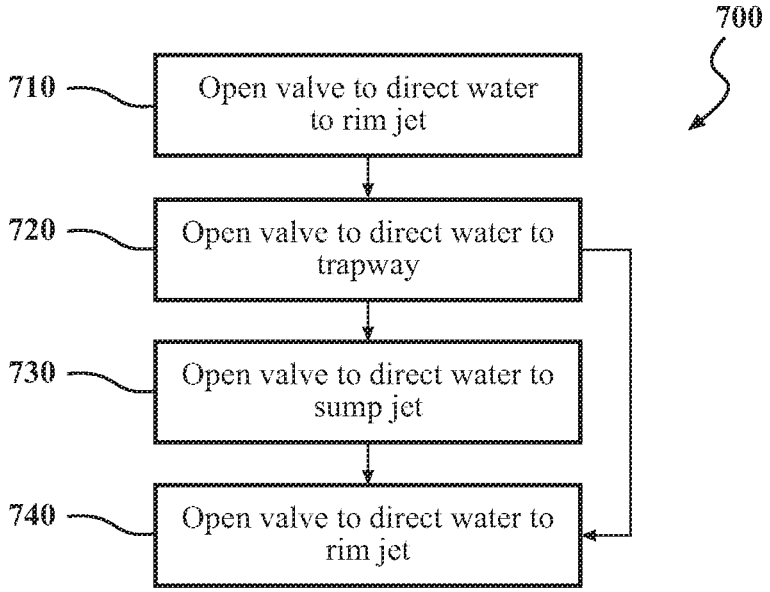
FIG. 7 is a flow chart illustrating an exemplary embodiment of a flush sequence for a tankless toilet.

For example, referring to the multi-stage flush process 700 illustrated in FIG. 7, once a flush (e.g., flush cycle) is activated by a user using an activation mechanism such as a handle or a button, the controller opens the rim valve 13*a* to supply water to the rim supply conduit 13 and the rim 10*b*. Through the one or more rim jets 13*b*, water flows from the underside of the rim 10*b* as a sheet-like layer along the inner surface of the bowl 10*a* to rinse and clean the bowl 10*a* of debris during a first predetermined time interval 710. The rim jets 13*b* are further configured to refill the bowl after the flush cycle is completed (i.e., after a third predetermined time interval discussed below). According to an exemplary embodiment, the rim valve 13*a* is configured to allow the full pressure and flow from the household supply source 19 through the rim jet 13*b*.

After the first predetermined time interval, the controller closes the rim valve 13*a* and opens the trapway valve 12*a* to allow water to flow to the trapway supply conduit 14. The water flowing through the trapway supply conduit 14 is introduced into the trapway 17 for a second predetermined time interval 720 (e.g., about one second). The trapway 17 has a unique structural configuration that can, advantageously, amplify the flow rate of water in the trapway 17 to help to prime the siphon and evacuate the bowl 10*a* in response to receiving the flow of water from the trapway supply conduit 14, the details of which are discussed in the paragraphs that follow. After the second predetermined time interval, the trapway valve 12*a* closes and the sump valve 12*b* opens to allow water to flow to the sump supply conduit 15 for a third predetermined time interval 730 (e.g., about 2-3 seconds). The water flowing through the sump supply conduit 15 is introduced into the sump 10*c* by the jet 16, which can rapidly diffuse the water from the sump supply conduit 15 and accelerate/mix the water and waste material contained in the sump 10*c* to further help to induce the siphon. After the third predetermined time interval, the rim valve 13*a* can then be re-opened to control a flow of water through the rim supply conduit 13 to the rim jet 13*b* to refill the bowl 10*a* during a fourth predetermined time interval 740.

In this manner, the trapway supply conduit 14 and the jet 16 can, advantageously, function to achieve the necessary flow rate of water (e.g., about 20-25 gpm) to prime the siphon and evacuate the bowl 10*a* of waste water toward an outlet 18 using a flow of water from a household supply source having a low supply line pressure (e.g., about 30 psi, etc.). According to one or more embodiments, the jet 16 can have a configuration that is the same as or similar to any one of, or a combination of, the jets described in Applicant's related U.S. patent application Ser. No. 15/414,576, titled "LINE PRESSURE-DRIVEN TANKLESS, SIPHONIC TOILET," the entire disclosure of which is hereby incorporated by reference herein.

According to another exemplary embodiment, the sump valve 12*b* is opened simultaneously with the trapway supply conduit 14 at the start of the second predetermined time interval. According to another exemplary embodiment, the sump valve 12*b* is not opened if the contents in the bowl 10*a* are only liquids (e.g., urine, etc.). In this situation, only the trapway valve 12*a* is opened to prime the siphon in the trapway 17. However, if the bowl 10*a* includes solid materials (e.g., waste, toilet paper, etc.), then the trapway valve 12*a* and the sump valve 12*b* can both be operated. In this way, the tankless toilet 10 can function as a "dual-flush" toilet to provide for further control over water usage depending on the contents of the bowl 10*a*.

Figure 2:
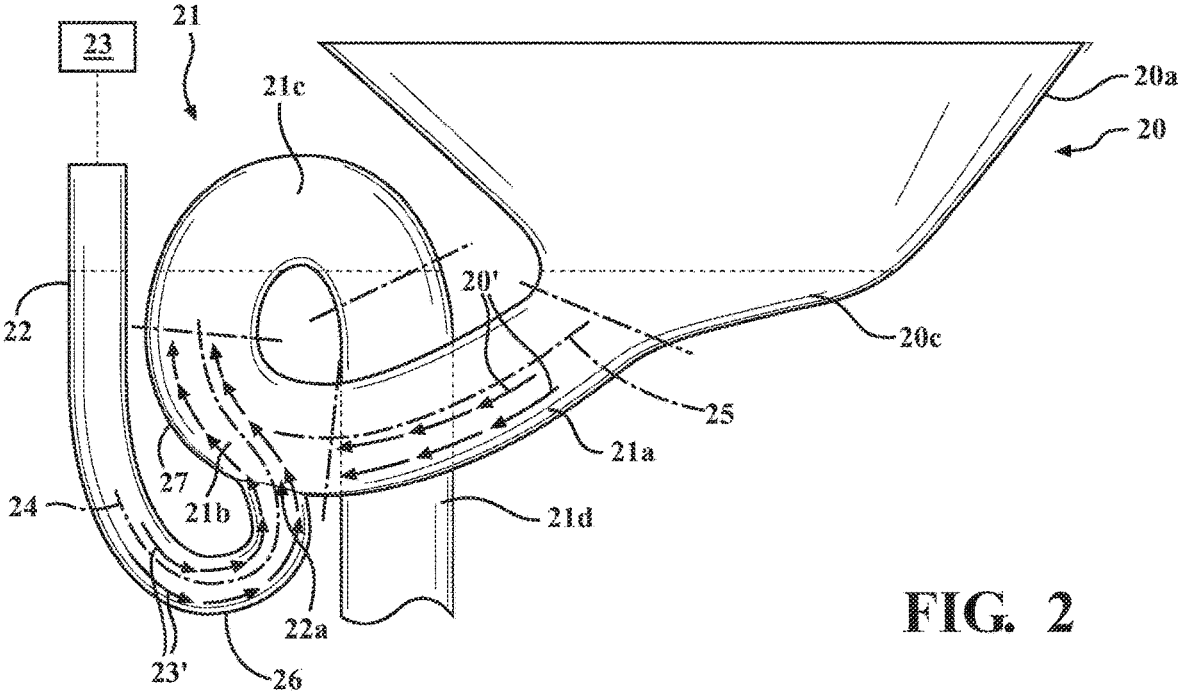
FIG. 2 is a partial side view of a tankless toilet according to another exemplary embodiment.

FIG. 2 illustrates a tankless toilet 20 according to another exemplary embodiment. The tankless toilet 20 is shown without a sump supply conduit or a jet, as compared to the tankless toilet 10 of FIG. 1. The tankless toilet 20, however, includes a trapway 21 having a similar configuration and design as the trapway 17 of the tankless toilet 10. For example, as shown in FIG. 2, the trapway 21 has a zeta (e.g., lowercase Greek letter) shaped design that wraps or loops partially around and closely follows the contour of a rear outer surface of a bowl 20*a* of the tankless toilet 20 to reduce the front-to-rear length of the toilet and provide for a more compact and efficient footprint. As utilized herein, the term "zeta shaped trapway" (or "zeta" in reference to a trapway) indicates a trapway including a first region 21*a* that extends outwardly away from a sump 20*c* of the tankless toilet 20, a second region 21*b* that curves upwardly from the first region 21*a* (e.g., toward the bowl 20*a*), a third region 21*c* that curves or loops partially around from the second region 21*b* back toward the sump 20*c* and downward along a side of the first region 21*a*, and a fourth region 21*d* that extends downward from the third region 21*c* past a side of the first region 21*a* (e.g., toward a drain of the tankless toilet 20). In this way, the first region 21*a*, the second region 21*b*, the third region 21*c*, and the fourth region 21*d* cooperatively define a trapway 21 having a generally zeta-shaped configuration that, advantageously, reduces the front-to-rear length of the toilet to provide for a more compact and efficient design, as compared to conventional toilet trapway designs.

Still referring to FIG. 2, a trapway supply conduit 22 is coupled to and in fluid communication with the trapway 21 at the second region 21*b*. As shown in FIG. 2, the trapway supply conduit 22 extends generally downward and loops partially around back toward the second region 21*b* of the trapway 21 in the direction of the trapway 21, such that the trapway supply conduit 22 is fluidly connected to the trapway 21 in an orientation such that a line of the trapway supply conduit 22 is tangent to a line of the upleg region of the trapway 17 within ±15° (e.g., at an interface 22*a* of the second region 21*b*). More preferably, the line of the trapway supply conduit is tangent to the line of the upleg region of the trapway within ±10° for desired performance, whereas ±15° (e.g., from 10° to 15° either side of nominally tangent) provides a reduced, but acceptable performance. By way of example, the line of the trapway supply conduit can be a centerline 24 or a line that follows the contour of an outer surface 26 or an inner surface and the line of the trapway can be a centerline 25 or a line that follows the contour of an outer surface 27 or an inner surface. The trapway supply conduit 22 is coupled to, or integrally formed with, the second region 21*b* at the interface 22*a*. According to other exemplary embodiments, the trapway supply conduit 22 interfaces with a different region of the trapway 21 that is downstream of the sump 20*c*, such as the first region 21*a* or the third region 21*c*. The first region 21*a*, the second region 21*b*, and the third region 21*c* cooperatively define an upleg region of the trapway 21. A flow of water 23' from a household water supply source 23 can enter the second region 21*b* of the trapway 21 through the trapway supply conduit 22 at the interface 22*a* via a valve (e.g., sump valve 12*b*, etc.). The tangential orientation of interface 22*a* between the trapway supply conduit 22 and the second region 21*b* within ±15° (or more preferably ±10°) advantageously, allows for water flowing in the trapway supply conduit 22 to follow the contour of the inner surface of the conduit 22 and continue in substantially the same direction into the second region 21*b* by relying on the Coanda effect. In this way, the flow of water 23' can substantially follow the direction of flow within the trapway 21 from the bowl 20*a* to amplify the flow rate of water in the trapway 21 to help to prime the siphon and evacuate the bowl 20*a*.

For example, as shown in FIG. 2, when a flush is initiated, a flow of water 23' from a household water supply source 23 is introduced into the trapway supply conduit 22 (e.g., via a control signal received by a valve from a controller, etc.). The flow of water 23' flows through the trapway supply conduit 22 and continues to follow the shape and contour of the supply conduit through the interface 22*a* and into the second region 21*b* by relying on the Coanda effect. That is to say, the flow of water 23' attaches itself to the inner surface of the trapway supply conduit 22 and remains attached even when the inner surface curves away from the initial direction of the flow of water 23' at the interface 22*a* and through the second region 21*b*. In this manner, the flow of water 23' can amplify and entrain water 20' that is present in the trapway 21 to help to prime the siphon of the tankless toilet 20.

Figure 3:
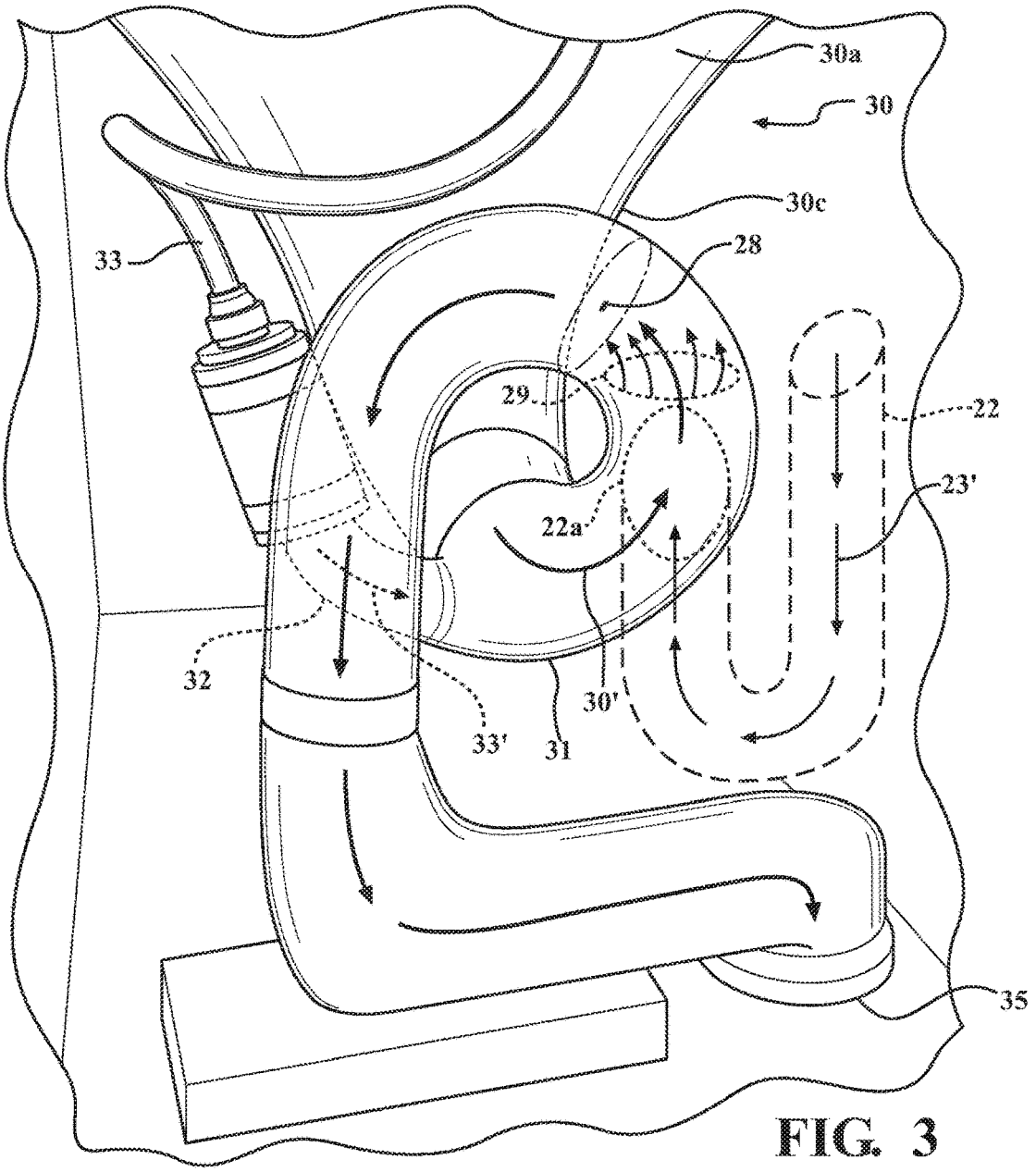
FIG. 3 is a partial perspective view of an exemplary embodiment of a trapway for a tankless toilet.

FIG. 3 shows a tankless toilet 30 according to another exemplary embodiment. The tankless toilet 30 has a trapway 31 having an identical zeta shape as the trapway 17 of the embodiment of FIG. 1, but without a sump supply conduit or sump jet. FIG. 3 is a rear perspective view of the toilet 30 that illustrates the general shape of, and flow directions through, the trapway 31. As shown in FIG. 3, a trapway supply conduit 32 extends from a household water supply source 33 to a substantially tangent interface at a portion of the trapway 31 located downstream of a sump 30*c* of the toilet 30. The trapway supply conduit 32 can provide a flow of water 33' from the household water supply source 33 at a low household supply pressure about 30 psi) to the trapway 31. The flow of water 33' from the trapway supply conduit 32 can, advantageously, increase the velocity and entrain water 30' that is present in the trapway 31 when a flush is initiated. In this way, the trapway supply conduit 32 can help to prime the siphon and evacuate the bowl 30*a* through an outlet 35. FIG. 3 also shows, as an alternative embodiment to the trapway supply conduit 32, the trapway supply conduit 22 at the location shown in FIG. 2. Thus, a toilet can include a supply conduit that couples to the trapway at different locations and has different configurations. The trapway supply conduit 22 connects to the trapway 31 at an interface 22*a* be a tangential orientation. Additionally, FIG. 3 shows the pattern of flow velocity 29 within the trapway 31 (see the cross-sectional circle in the trapway having different length arrows), and the center point 28 within the trapway 31 in which the flow velocity is maximized. In addition, as shown in FIG. 3, the zeta shape of the trapway 31 provides for a more compact and efficient design of the toilet 30 by reducing the front to rear length of the toilet 30, thereby allowing for more design flexibility and installation options, as compared to conventional toilet trapway designs.

Figure 4:
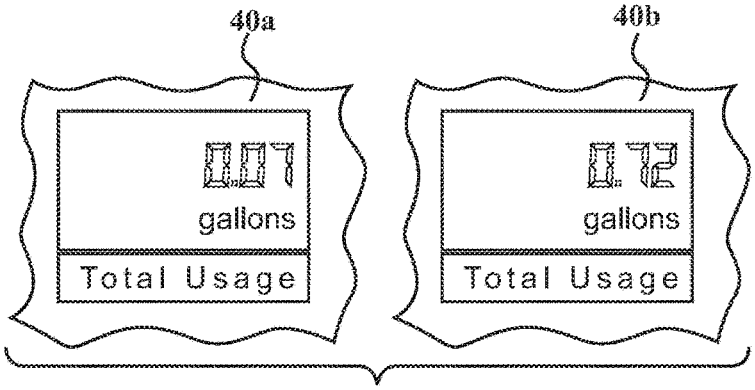
FIG. 4 illustrates water usage data of two different toilet trapway designs.

FIG. 4 illustrates water usage data for the tankless toilet 30 shown in FIG. 3, according to an exemplary embodiment. As shown in FIG. 4 at screenshot 40*a*, the total water usage of the trapway supply conduit 32 to prime the siphon is about 0.07 gallons, which is sufficient to induce a siphonic effect to flush fluids from the bowl 30*a*, such as urine. Screenshot 40*b* illustrates the total water usage for an entire flush cycle of the tankless toilet 30, which is about 0.72 gallons. This water usage is significantly less than conventional gravity-driven or pressure fed toilets.

Figure 5:
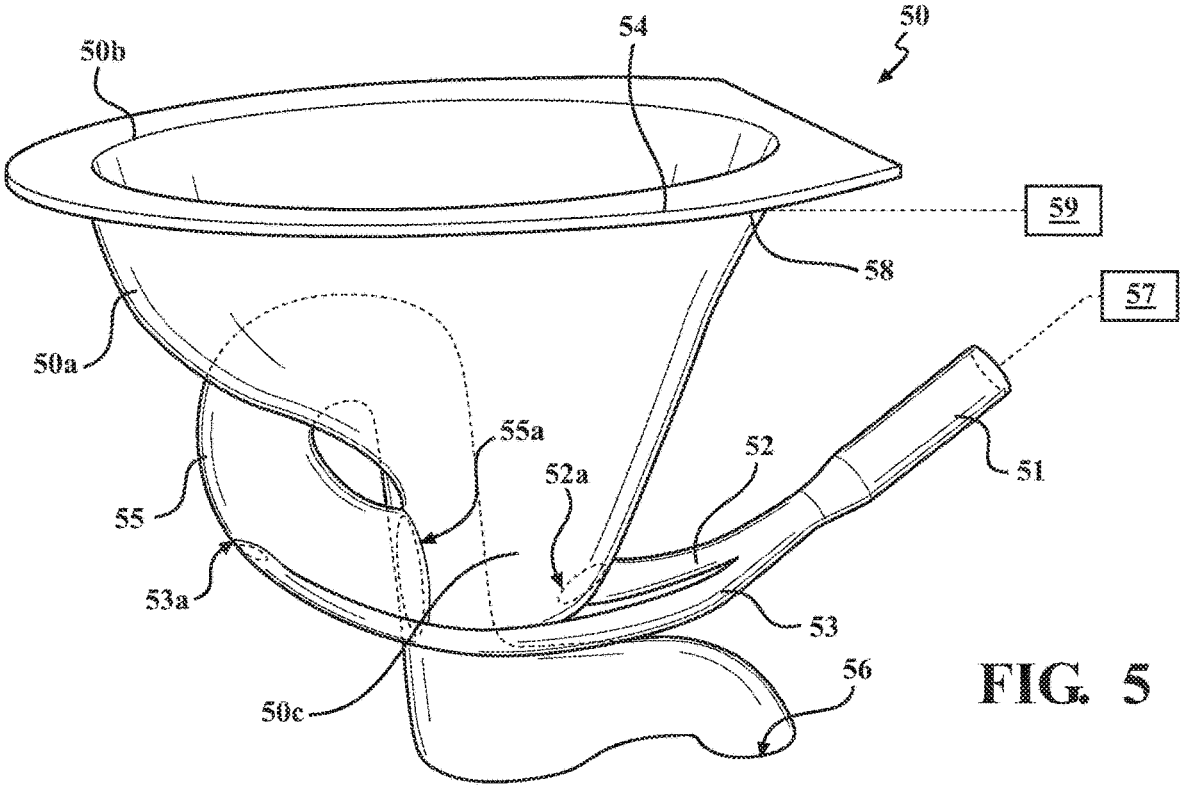
FIG. 5 is a perspective view of a tankless toilet according to another exemplary embodiment.

FIG. 5 illustrates a tankless toilet 50 according to another exemplary embodiment. The tankless toilet 50 uses a gravity fed water source to help to prime a siphon in the trapway. As shown in FIG. 5, the tankless toilet 50 includes a bowl 50*a* surrounded by a rich 50*b* along an upper portion of the bowl. The tankless toilet 50 further includes a sump 50*c* located at a bottom portion of the toilet. A trapway 55 extends from a front portion of the sump 50*c* at an interface 55*a* and loops partially around a front portion of the bowl 50*a* and downward adjacent a side portion of the bowl 50*a* toward an outlet 56 to define a generally zeta-shape. Similar to the embodiments of FIGS. 1-3, the trapway 55 has a zeta shape that significantly reduces the front-to-rear length of the toilet, so as to provide for a more compact and efficient design footprint. The tankless toilet 50 further includes a rim supply conduit 58 in fluid communication with a household water supply source 59, which is configured to provide a flow of water to the rim supply conduit 58 at a household supply line pressure. The rim supply conduit 58 is coupled to, and in fluid communication with, a rim jet 54. The rim jet 54 is configurable the same as the rim jet 13*b* of FIG. 1.

Still referring to FIG. 5, a main conduit 51 is in fluid communication with a water source 57, which is configured to provide a flow of water to the main conduit 51 via only gravity. According to an exemplary embodiment, the water source 57 is a tank contained in a wall of a building. According to another exemplary embodiment, the water source 57 is a traditional water tank located above the base or pedestal of the toilet 50. The main conduit 51 splits off into a sump supply conduit 52 and a trapway supply conduit 53. The sump supply conduit 52 is coupled to and in fluid communication with the sump 50*c* at an interface 52*a* located at a rear portion of the sump 50*c*. The trapway supply conduit 53 is coupled to and in fluid communication with the trapway 55 at an interface 53*a* that is substantially tangent to the trapway 55 located downstream of the sump 50*c*, similar to the trapway configurations shown in FIGS. 1-3. According to an exemplary embodiment, at least one of the main conduit 51, the sump supply conduit 52, the trapway supply conduit 53, and the rim supply conduit 58 includes a valve for controlling a flow of water from the water sources 57 and 59 to the sump 50*c*, the trapway 55, and the rim 50*b*, respectively. The valve may be electronically controlled via a controller to selectively and intermittently control water flow to the sump 50*c*, trapway 55, and the rim 50*b*, as illustrated in the exemplary flush sequence of FIG. 7. In this manner, the sump supply conduit 52, the trapway supply conduit 53, and the rim supply conduit 58 can amplify the flow rate of water in the sump 50*c* and the trapway 55 to prime the siphon and evacuate the bowl 50*a* of its contents.

Figure 6:
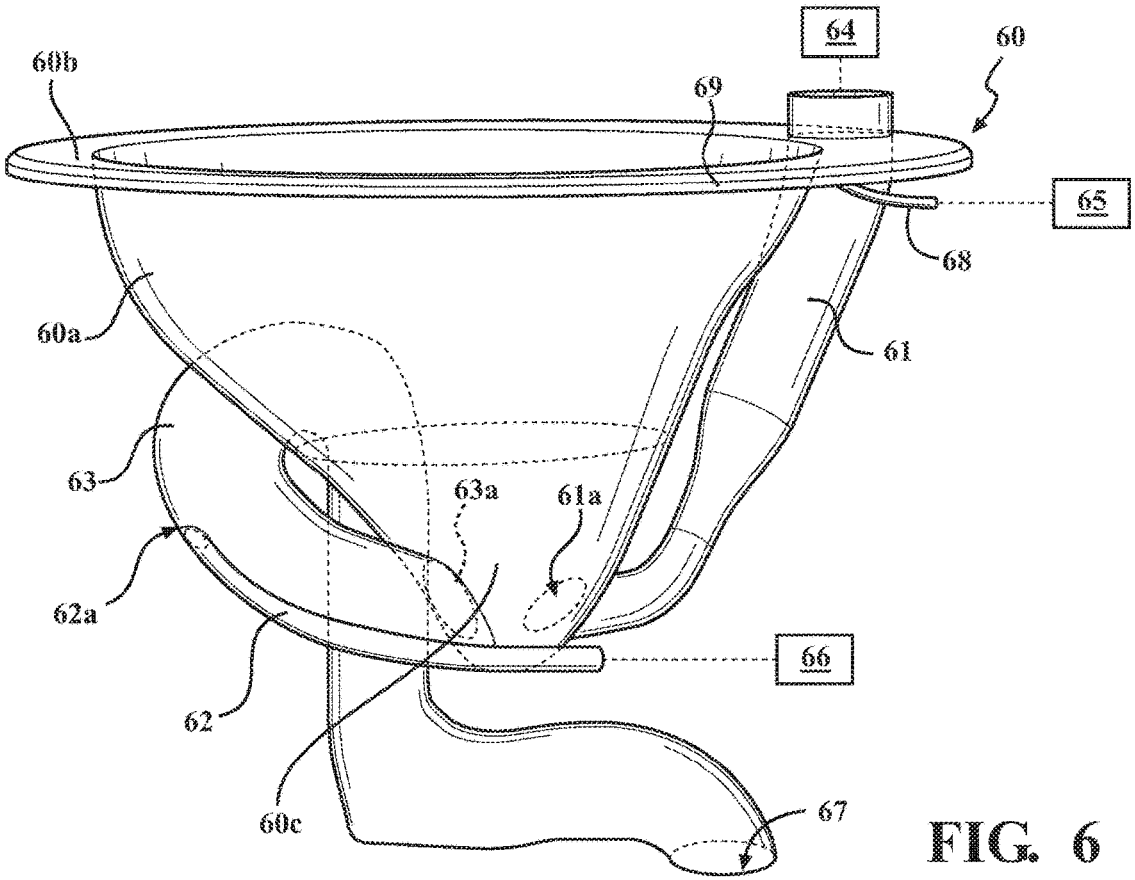
FIG. 6 is a perspective view of a tankless toilet according to another exemplary embodiment.

FIG. 6 illustrates a tankless toilet 60 according to another exemplary embodiment. The tankless toilet 60 includes a bowl 60*a* surrounded by a rim 60*b* along an upper portion of the bowl. The tankless toilet 60 further includes a sump 60*c* located at a bottom portion of the toilet. A trapway 63 extends from a front portion of the sump 60*c* at an interface 63*a* and loops around a front portion of the bowl 60*a* and downward adjacent a side portion of the bowl 60*a* toward an outlet 67. Similar to the embodiments of FIG. 5, the trapway 63 has a zeta shape that significantly reduces the front-to-rear length of the toilet to provide for a more compact and efficient design footprint. The tankless toilet 60 further includes a rim supply conduit 68 in fluid communication with a household water supply source 65, which is configured to provide a flow of water to the rim supply conduit 68 at a household supply line pressure. The rim supply conduit 68 is coupled to, and in fluid communication with, a rim jet 69. According to an exemplary embodiment, the rim jet 69 is configured the same as the rim jet 13*b* of FIG. 1.

Still referring to FIG. 6, a sump supply conduit 61 is in fluid communication with water source 64, which is configured to provide a flow of water via only gravity to the sump 60*c* at an interface 61*a* located at a rear portion of the sump 60*c*. A trapway supply conduit 62 is in fluid communication with a household water supply source 66, which is configured to provide a flow of water at a low household supply line pressure (e.g., about 30 psi) to the trapway 63 at an interface 62*a* that is substantially tangent to the trapway 63 located downstream of the sump 60*c*, similar to the trapway configurations shown in FIGS. 1-3 and 5. According to another exemplary embodiment, the trapway supply conduit 62 is in fluid communication with a different water source, such as water source 64 that is configured to provide a flow of water via only gravity. According to an exemplary embodiment, at least one of the sump supply conduit 61, the trapway supply conduit 62, or the rim supply conduit 68 includes one or more valves for controlling a flow of water from the water supply sources 64, 65, and 66 to the sump 60*c*, the trapway 63, and the rim 60*b*, respectively. The one or more valves may be electronically controlled via a controller to selectively and intermittently control water flow to the sump 60*c*, the trapway 55, and the rim 60*b*, as illustrated in the exemplary flush sequence of FIG. 7. In this manner, the sump supply conduit 61, the trapway supply conduit 62, and the rim supply conduit 68 can amplify the flow rate of water in the sump 60*c*, the trapway 63, and the bowl 60*a* to prime the siphon and evacuate the bowl 60*a* of its contents.

Figure 8:
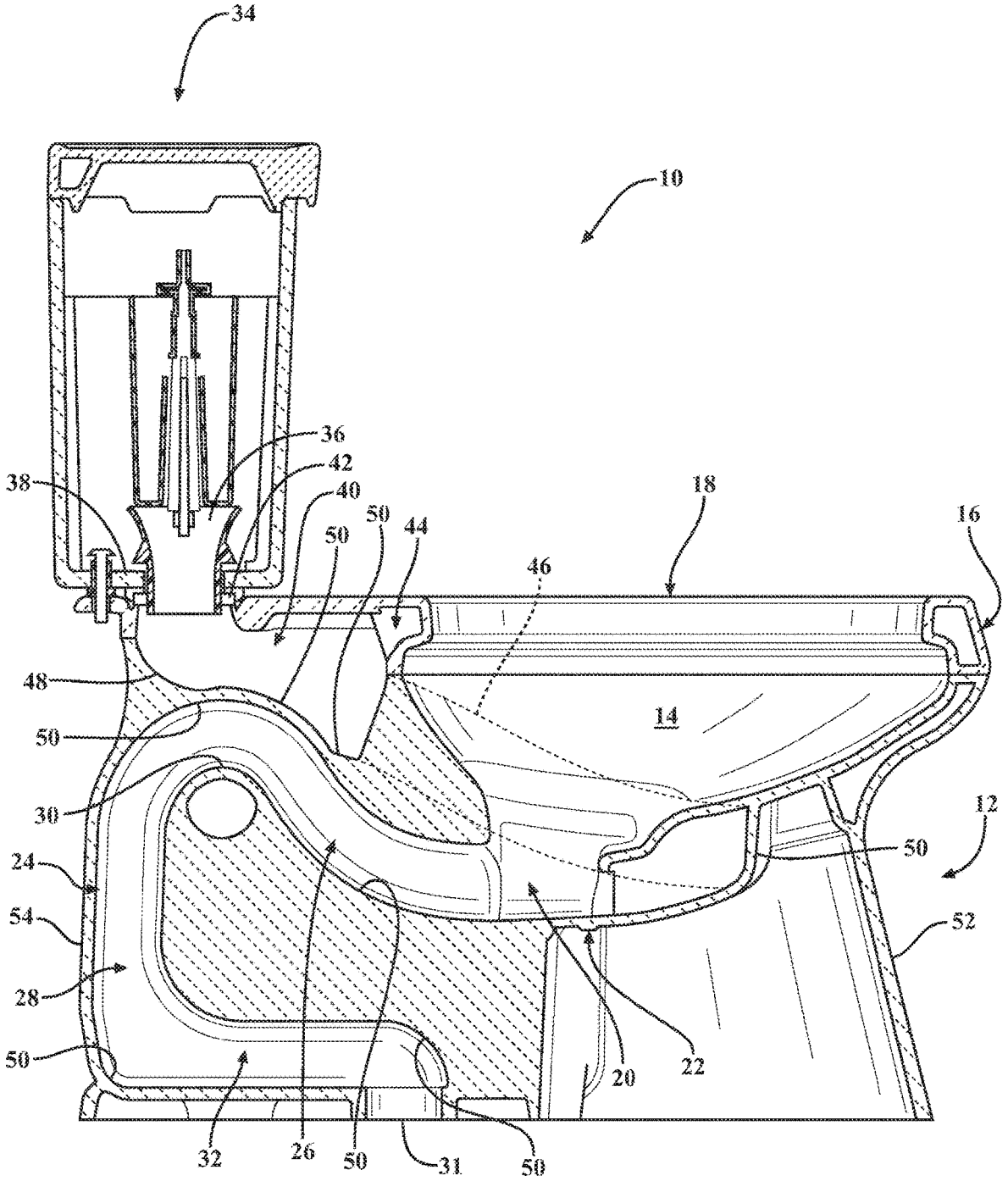
FIG. 8 PRIOR ART
FIG. 8 is a cross-sectional view of a conventional toilet according to the prior art.

FIG. 8 illustrates a conventional toilet 10 (i.e., a toilet assembly) according to prior art. The toilet 10 includes a pedestal 12 with a bowl 14 formed therein. The bowl 14 includes a rim 16 at an upper end 18 thereof and a sump 20 at a lower end 22 of the bowl 14. A trapway 24 extends downstream from the sump 20 and includes an up-leg 26 and a down-leg 28 extending directly downstream from the up-leg 26, forming a weir 30 between the up-leg 26 and the down-leg 28. A trapway outlet 31 is defined at a downstream end of the trapway 24, and the trapway 24 shown in FIG. 8 includes an extension leg 32, which extends downstream from the down-leg 28 to the trapway outlet 31. The trapway outlet 31 may be disposed in a central portion of the pedestal 12 and aligned with a drain opening in a floor of a bathroom.

The toilet 10 further includes a tank 34 disposed on the pedestal 12 and a flush valve 36 (i.e., flush canister) disposed in the tank 34 and extending downward through a lower surface 38 of the tank 34 into an inlet passage 40 formed in the pedestal 12. During the operation of a flush sequence, the flush valve 36 releases water into the inlet passage 40 through an inlet opening 42 at an upstream end of the inlet passage 40 for flushing the toilet 10. The pedestal 12 further includes a rim channel 44 extending downstream from the inlet passage 40 and configured to provide water from the inlet passage 40 to the bowl 14 through the rim 16. The pedestal 12 also includes a sump channel 46 extending downstream from the inlet passage 40 and fluidly connecting the inlet passage 40 to the sump 20, providing water thereto from the inlet passage 40.

In the conventional toilet 10 shown in FIG. 8, when water is introduced to the inlet passage 40, it first passes through an elbow 48 in the inlet passage 40. The water then passes through a plurality of turns 50 in the inlet passage, the sump channel 46, the sump 20, and the trapway 24. It should be understood that at each of the turns 50, water in the toilet 10 changes rotational direction, which increases turbulence and, therefore, resistance in the flow, thereby reducing operational efficiency of the toilet 10. As shown in FIG. 8, a first turn 50 is formed downstream from the elbow 48 and upstream from the sump channel 46. A second turn 50 is formed in the inlet passage 40, directing the flow of water downward in the direction of a forward end 52 of the toilet 10 and toward the sump 20. A third turn 50 is formed in the sump channel 46, directing the flow of water in the direction of a rear end 54 of the toilet 10 toward the sump 20. A fourth turn 50 is formed as the water flows through the up-leg 26 from the sump 20, a fifth turn 50 is formed at the weir 30, and a sixth turn 50 is formed where the extension leg 32 extends from the down-leg 28, redirecting the flow from a downward direction toward the trapway outlet 31. A final seventh turn 50 is formed in the extension leg 32 proximate the trapway outlet 31, redirecting waste and water in a downward direction. Due to the number of turns 50 in the toilet 10, the total length of the water flow path between the inlet opening 42 and the trapway outlet 31, including the inlet passage 40, the sump channel 46, the sump 20, and the trapway 24 may be at least approximately 56 inches. It should be further understood that the total length of the water flow path corresponds directly with the skin friction acting on the water, and a longer length increases resistance in the toilet 10 and therefore requires a larger water volume to have the same flush force as a toilet having a shorter length flow path with fewer turns.

Figure 9:
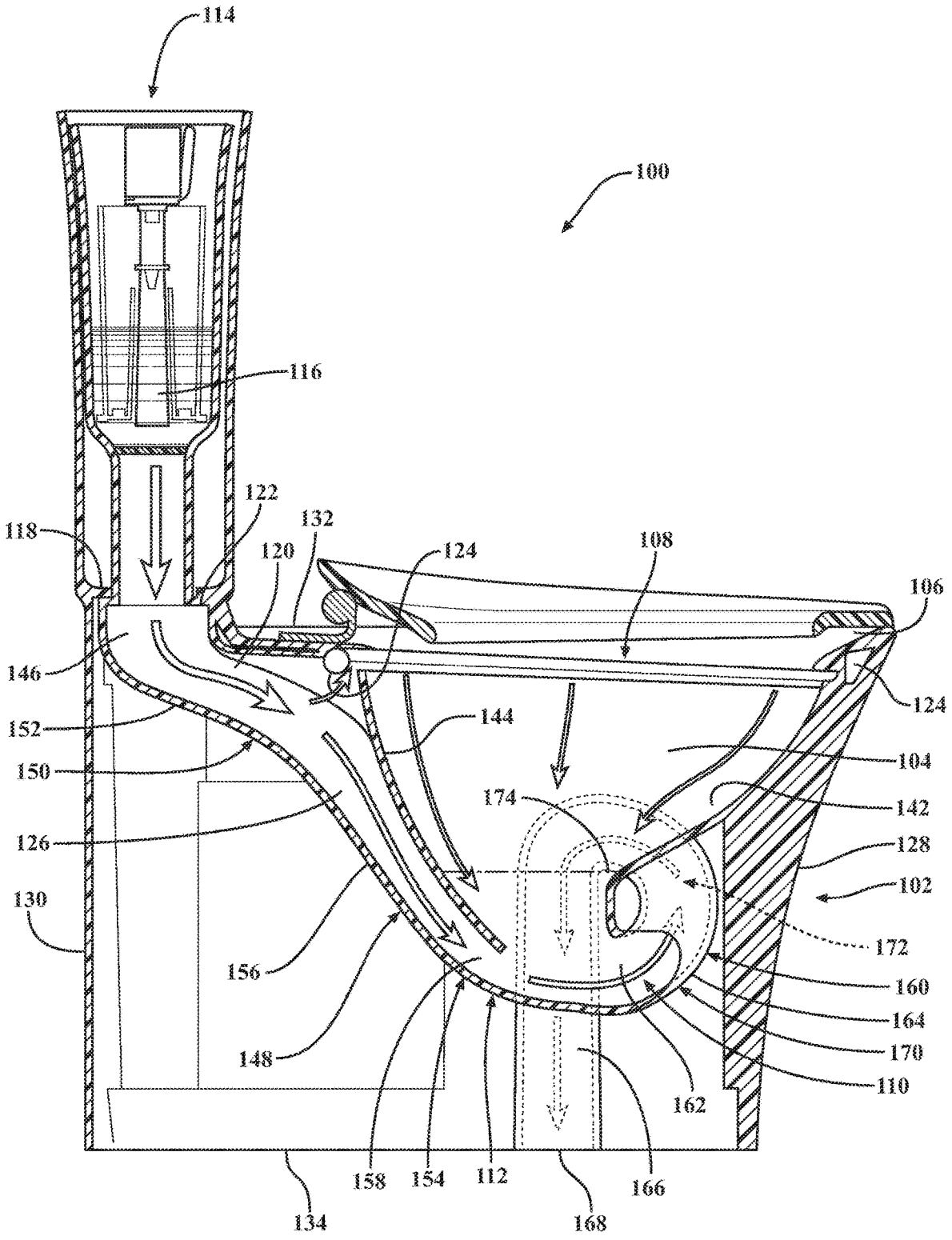
FIG. 9 is a cross-sectional view of a toilet with a low-volume flush according to an exemplary embodiment of this application.
Figure 10:
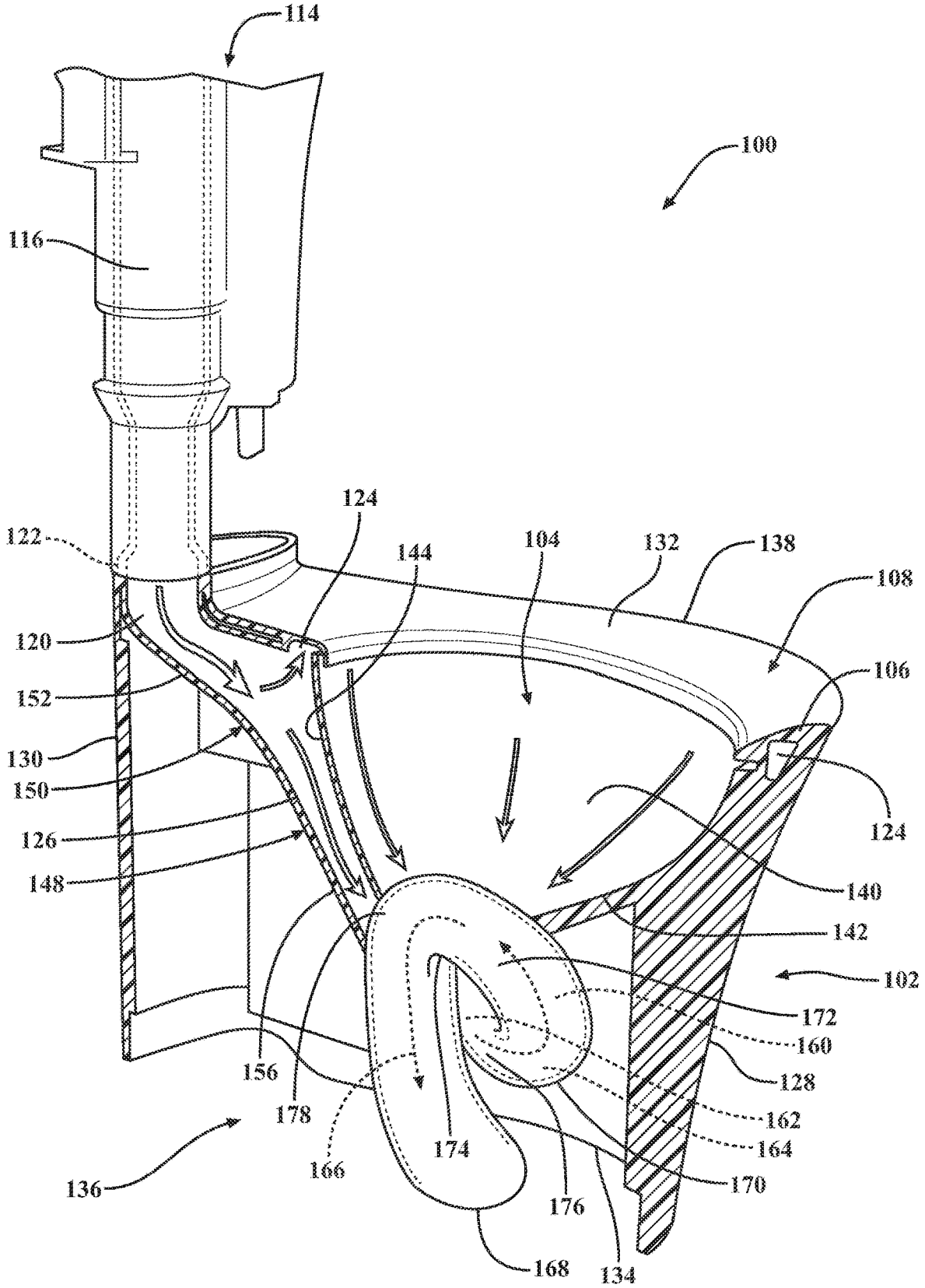
FIG. 10 is a perspective cross-sectional view of the toilet shown in FIG. 9.

FIGS. 9 and 10 illustrate a toilet 100 with high-efficiency and low water volume use is shown according to an exemplary embodiment. The toilet 100 includes a pedestal 102 with a bowl 104 formed therein. The bowl 104 includes a rim 106 at an upper end 108 thereof and a sump 110 at a lower end 112 of the bowl 104. The toilet 100 further includes a tank 114 disposed on the pedestal 102 and a flush valve 116 (i.e., flush canister) disposed in the tank 114 and extending downward through a lower surface 118 of the tank 114 into an inlet passage 120 formed in the pedestal 102. During the operation of a flush sequence, the flush valve 116 releases water into the inlet passage 120 through an inlet opening 122 at an upstream end of the inlet passage 120 for flushing the toilet 100.

The pedestal 102 further includes a rim channel 124 extending downstream from the inlet passage 120 and configured to provide water from the inlet passage 120 to the bowl 104 through the rim 106. The pedestal 102 also includes a sump channel 126 extending downstream from the inlet passage 120 and fluidly connecting the inlet passage 120 to the sump 110, providing water thereto from the inlet passage 120.

In the configuration shown in FIGS. 9 and 10, the pedestal 102 defines a forward end 128 and an opposing rear end 130, an upper surface 132 and an opposing lower surface 134, and a first side 136 and an opposing second side 138. The first side 136 is shown as a right side of the toilet 100 from the perspective of a user seated on the pedestal 102 and the second side 138 is shown as a left side of the toilet 100. However, it should be understood that the configuration of the toilet 100 may be flipped laterally, such that the first side 136 refers to the left side of the toilet 100 and the second side 138 refers to the right side of the toilet 100. The bowl 104 defines an inner surface 140 configured to receive waste and water, and an opposing outer surface 142, which is concealed within the pedestal 102. Specifically, the bowl 104 includes a bowl rear portion 144, which faces the rear end 130 of the pedestal 102. For example, the bowl rear portion 144 may include a rearmost end of the bowl 104. The sump channel 126 is disposed directly on the outer surface 142 of the bowl 104 proximate or at the bowl rear portion 144. According to an exemplary embodiment, the sump channel 126 is integrally formed with the bowl 104, such that the bowl rear portion 144 forms a portion of the sump channel 126, enclosing water within the sump channel 126. As water is supplied to the sump channel 126 from the inlet passage 120, the water flows downwardly on an angle in the sump channel 126 from the inlet passage 120 toward the sump 110. For example, the sump channel 126 extends downstream in a direction from the rear end 130 of the pedestal 102 toward the forward end 128 and in the direction from the upper surface 132 toward the lower surface 134. In this configuration, the sump channel 126 follows the curvature of the outer surface 142 of the bowl 104.

When water is introduced through the inlet opening 122 to the inlet passage 120, it first passes through an elbow 146 in the inlet passage 120. It should be understood that the combined structure of the inlet passage 120 and the sump channel 126 form a collective water supply passage 148, which receives water from the inlet opening 122 and passes the water to the sump 110 without first passing it through the rim channel 124.

Specifically, the elbow 146 redirects water from flowing in a generally downward direction to an approximately forward direction. A first turn 150 is formed proximate an upstream end of the sump channel 126, where the rim channel 124 separates flow in the inlet passage 120 into separate flows in each of the rim channel 124 (e.g., rim water, rim jet, etc.) and the sump channel 126 (e.g., sump water, sump jet, etc.). At the first turn 150, the sump channel 126 redirects the flow of water further downward, more directly toward the lower surface 134 of the pedestal 102. The water supply passage 148 at the inlet passage 120 defines a first inflection point 152 (i.e., a first vertical inflection point), in which the water supply passage 148 switches from convex to concave in the direction from the lower surface 134 looking toward the upper surface 132. In this location, the inlet passage 120 begins to bend downward as the water flows through the first turn 150. It should be understood that while FIGS. 9 and 10 show the first turn 150 formed between the inlet passage 120 and the sump channel 126, according to other exemplary embodiments, the first turn 150 may be formed in other portions of the water supply passage 148, such as only one of the inlet passage 120 or the sump channel 126.

At a downstream end of the sump channel 126, proximate and upstream from the sump 110, the sump channel 126 forms a second turn 154 (e.g., an upstream end of the second turn 154). Specifically, the water in the sump channel 126 is redirected more directly toward the forward end 128 of the pedestal 102 and substantially horizontally (i.e., less downward) through a sump channel outlet 158 at a rear end of the sump and into the sump 110. Between the first turn 150 and the second turn 154, the sump channel 126 includes a second inflection point 156 (i.e., a second vertical inflection point), in which the flow of water transitions from approximately convex back to concave.

Referring still to FIGS. 9 and 10, the toilet 100 includes a trapway 160 extending downstream from the sump 110. The trapway 160 includes a trapway inlet 162 formed in a forward end of the sump and opposing the sump channel outlet 158. For example, water may flow from the sump channel outlet 158 through the sump 110 and into the trapway inlet 162 in a substantially horizontal direction and in substantially laminar flow moving in a direction from the rear end 130 of the toilet 100 toward the forward end 128 of the toilet 100. This flow of water through the sump 110 generates a siphon in the trapway 160 during a flush sequence and evacuates the contents of the bowl 104, including solid and liquid waste.

The trapway 160 includes an up-leg 164 extending downstream from the sump 110, a down-leg 166 extending downstream from the up-leg 164, and a trapway outlet 168 at a downstream end of the down-leg 166 and configured to output water and waste from the toilet 100 into a drain opening. The trapway 160 is continuous from the second turn 154, such that the second turn 154 in the sump channel 126 and the trapway 160 form one continuous turn having a generally zeta shape. In other words, there is no inflection point formed in a vertical direction along the flow path between the second inflection point 156 and the trapway outlet 168, as will be discussed in further detail below.

The trapway 160 at the up-leg 164 includes a first portion 170, which curves toward the forward end 128 and generally vertically from the trapway inlet 162. The first portion 170 also curves toward the first side 136 of the toilet 100, such that the up-leg 164 curves laterally around the outer surface 142 of the bowl 104. The trapway 160 at the up-leg 164 further includes a second portion 172, which extends from the first portion 170 and curves toward the rear end 130 of the toilet 100 until the water in the trapway 160 flows in a substantially horizontal direction. The second portion 172 is disposed proximate the first side 136 that the first portion 170 is curved toward.

The trapway 160 forms a weir 174 at a downstream end of the up-leg 164 and an upstream end of the down-leg 166, defining an upper peak in the trapway 160, which is disposed at a height above the trapway inlet 162 to provide a water level in the bowl 104. During the flush sequence, water begins flowing through the trapway 160 when the water level in the bowl 104 rises above the height of the weir 174. The down-leg 166 extends downstream from the weir 174 to the trapway outlet 168. As shown in FIGS. 9 and 10, the down-leg 166 extends vertically downward to the trapway outlet 168. For example, the down-leg 166 may form a substantially straight vertical path, such that the trapway outlet 168 is disposed approximately directly below the weir 174. In this configuration, the weir 174 and therefore the trapway outlet 168 is disposed in the pedestal 102 laterally offset from a center of the toilet 100 due to the up-leg 164 curving laterally around the outer surface 142 of the bowl 104. As a result, the trapway outlet 168 may be disposed laterally offset from a drain opening in the floor of a bathroom. According to another exemplary embodiment, as shown in FIG. 10, the down-leg 166 curves around and under the bowl 104 and the sump 110 downward and at an angle laterally from the first side 136 to the second side 138 of the toilet 100 toward the trapway outlet 168, which is disposed in the lower surface 134 equidistant between the first and second sides 136, 138.

In the configuration shown in FIGS. 9 and 10, the up-leg 164 and the down-leg 166 form one continuous turn extending from the sump channel 126. As a result, the entire water flow path through the water supply passage 148 and the trapway 160 (e.g., between the elbow 146 and the trapway outlet 168) includes two turns (e.g., the first turn 150 and the second turn 154) in a vertical direction. In other words, in the longitudinal direction (i.e., taken along a longitudinal axis from the forward end 128 to the rear end 130 of the toilet 100) the water flow path includes just two inflection points (e.g. the first inflection point 152 and the second inflection point 156), rather than seven as provided in the conventional toilet 10.

As shown in FIG. 10 and as discussed above, the up-leg 164 extends laterally in the pedestal 102 toward the first side 136. In this configuration, the up-leg 164 may define a third inflection point 176 (i.e., a first lateral inflection point) as the up-leg 164 curves laterally from the sump 110. The down-leg 166 is further shown extending laterally toward the second side 138 of the toilet 100. The transition in the down-leg 166 of the trapway 160 back toward the second side 138 and away from the first side 136 defines a fourth inflection point 178 (i.e., a second lateral inflection point). The toilet 100 may include a total of four inflection points including both in the longitudinal direction and the lateral direction, which is less than the number of turns 50 and therefore inflection points in the conventional toilet 10.

By reducing the number of turns along the flow path (e.g., in a longitudinal direction) to two turns, the flow path reduces the amount of times water changes direction and therefore reduces overall turbulence. Further, the water flow path in the toilet 100 is shorter than in the conventional toilet 10. Specifically, each turn in a toilet requires a minimum radius and length in order to ensure that the turn is not too tight, which would cause solid waste to become lodged in the trapway and the toilet to become clogged. This minimum radius and length requirement leads to a longer trapway. By reducing the number of turns, the toilet 100 may have a total water flow path length of between approximately 40 inches and 54 inches. According to an exemplary embodiment, the water flow path length may be between approximately 40 inches and 46 inches. According to yet another exemplary embodiment, the water flow path length may be approximately 42 inches (e.g., 42.0 inches+/−0.5 inches). By reducing the total length of the water flow path from 56 inches in the conventional toilet 10 to approximately 42 inches, the toilet 100 significantly reduces the "skin" friction experienced by water during the flush sequence and therefore reduces the volume of water required during the flush sequence.

It should further be understood that by compacting the trapway 160 in the toilet 100 to below and around the outer surface 142 of the bowl 104, an overall longitudinal length between the forward end 128 and the rear end 130 may be reduced since there is no requirement for accommodating the trapway 160 rearward of the bowl 104. As a result, the forward end 128 of the toilet 100 may be located closer to a wall, which provides additional clearance from structures opposing the forward end 128 of the toilet 100. For example, ADA compliance requirements may dictate a minimum distance between a door and a toilet to ensure maneuverability in a bathroom for people with disabilities. By reducing the length of the toilet 100 as provided, it becomes easier to have sufficient clearance from nearby obstacles in the bathroom without having to redesign the bathroom from an older non-compliant design with a conventional toilet.

Figure 11:
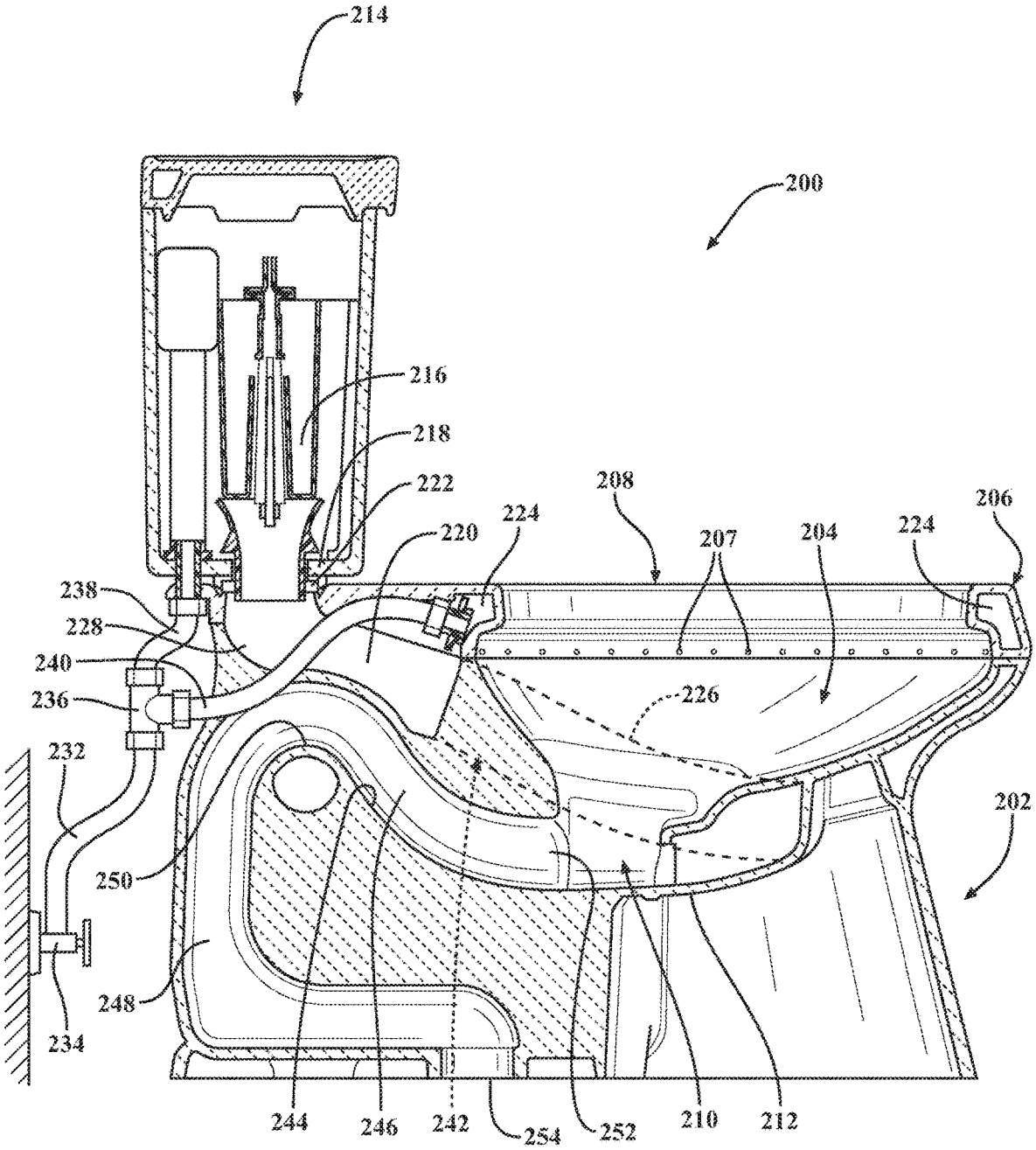
FIG. 11 is a cross-sectional view of a toilet with a hybrid flush engine according to an exemplary embodiment.

FIG. 11 illustrates a toilet 200 with a hybrid flush engine according to an exemplary embodiment. As used throughout this application, the term "flush engine" refers to the structures in a toilet, which pass water and/or waste through the toilet, such as water supply lines, an inlet passage, sump and rim channels, a bowl and sump, and a trapway. As shown in FIG. 11, the toilet 200 includes a pedestal 202 with a bowl 204 formed therein. The bowl 204 includes a rim 206 at an upper end 208 thereof and a sump 210 at a lower end 212 of the bowl 204. The toilet 200 further includes a tank 214 disposed on the pedestal 202 and a flush valve 216 (i.e., flush canister) disposed in the tank 214 and extending downward through a lower surface 218 of the tank 214 into an inlet passage 220 formed in the pedestal 202. According to another exemplary embodiment, the tank 214 may be located in the bathroom remotely from the pedestal 202 (e.g., concealed within a bathroom wall). During the operation of a flush sequence, the flush valve 216 releases water into the inlet passage 220 through an inlet opening 222 at an upstream end of the inlet passage 220 for flushing the toilet 200.

The pedestal 202 further includes a rim channel 224 formed in the rim 206 and configured to provide water to the bowl 204 through the rim 206 for washing down the sides of the bowl 204 during a flush sequence. Specifically, the rim 206 includes at least one rim outlet 207 formed in the rim 206 and fluidly connecting the rim channel 224 to the bowl 204 for supplying water thereto. According to another exemplary embodiment, the rim 206 includes a plurality of rim outlets 207 formed annularly about the rim 206 for providing water to the bowl 204. The pedestal 202 also includes a sump channel 226 extending downstream from the inlet passage 220 and fluidly connecting the inlet passage 220 to the sump 210, providing water thereto from the inlet passage 220. When water is introduced through the inlet opening 222 to the inlet passage 220, it first passes through an elbow 228 in the inlet passage 220. It should be understood that the combined structure of the inlet passage 220 and the sump channel 226 receive water from the inlet opening 222 and passes the water to the sump 210 without first passing it through the rim channel 224.

A water supply line 232 is fluidly connected to a water source 234 (e.g., a valve, spigot, etc.) in a bathroom and configured to provide pressurized water (e.g., at line pressure of approximately 30 psi) to the toilet 200. A fitting 236 (e.g., a splitter fitting, T-fitting, T-connector, etc.) is coupled to a downstream end of the water supply line 232 and is coupled to a tank supply line 238 and a rim supply line 240. The fitting 236 splits (i.e., divides, separates, etc.) the stream of water received in the water supply line 232 from the water source 234 into a tank water supply fed to the tank 214 through the tank supply line 238 and a rim supply fed to the rim channel 224 through the rim supply line 240. By connecting both the tank supply line 238 and the rim supply line 240 to a single water supply line 232, the toilet 200 may be connected to a single conventional water source 234 installation without requiring two separate water sources 234 in the bathroom. The tank supply line 238 and the rim supply line 240 may be formed from a flexible material and selectively coupled to the tank 214 and the rim channel 224, respectively. According to another exemplary embodiment, one or both of the tank supply line 238 and the rim supply line 240 may be integrally formed with the toilet 200. For example, the rim supply line 240 may be formed within the pedestal 202 during a vitreous casting process.

The tank supply line 238 is fluidly coupled to the tank 214, such as through a fill valve, and is configured to supply the tank water supply to the tank 214 when the water level in the tank drops below a threshold height, particularly after water is quickly introduced to the bowl 204 during a flush sequence. The rim supply line 240 is fluidly coupled to (e.g., directly to) the rim channel 224 and is configured to supply the rim water supply to the rim channel 224 after the activation of the flush sequence. The rim supply line 240 may be mechanically linked to an actuator or the flush valve 216, such that when the flush sequence is activated by the actuator, the rim supply line 240 provides the rim water supply to the rim channel 224 and into the bowl 204 for washing down the sides of the bowl 204 and removing waste therefrom. For example, the rim supply line 240 may include a valve (e.g., at the inlet, at the outlet), which is coupled either mechanically or electrically to the actuator. The valve may remain open for a set period of timing following the activation of the flush sequence or may close based on a condition in the bowl 204 or in the tank 214. According to another exemplary embodiment, the fitting 236 may control the flow of water in the rim supply line 240. For example, when the flush sequence is activated and the water in the tank 214 is evacuated into the bowl 204, a pressure in the tank supply line 238 drops. This pressure drop may open a valve in the fitting 236, which introduces water to both the tank supply line 238 and the rim supply line 240, thereby supplying water to the rim channel 224 through the rim supply line 240. It should be understood that the supply of water to the rim channel 224 through the rim supply line 240 may be provided in other ways.

Referring still to FIG. 11, the toilet 200 includes a trapway 244, including an up-leg 246 extending downstream from the sump 210 and a down-leg 248 extending downstream from the up-leg 246. The trapway 244 forms a weir 250 at a downstream end of the up-leg 246 and an upstream end of the down-leg 248, defining an upper peak in the trapway 244, which is disposed at a height above a trapway inlet 252 at the sump 210, providing a water level in the bowl 204. The down-leg 248 extends downstream from the weir 250 to a trapway outlet 254.

In the configuration shown in FIG. 11, the rim channel 224 is fluidly separated (e.g., disconnected) from the tank 214. Specifically, the tank 214 is configured to provide water directly to the sump 210 through the inlet passage 220 and the sump channel 226 (collectively a sump water supply passage 242), without providing any water to the rim channel 224. A siphon is formed when water from the tank 214 is introduced to the bowl 204 and the trapway 244 through the sump 210 and raises the water level in the up-leg 246 of the trapway 244 above the height of the weir 250. The larger the volume of water in the trapway 244, the faster the siphon will be generated therein. Specifically, a siphon generally forms when substantially an entire cross-sectional area of the trapway 244 downstream from the weir 250 is filled with water.

A conventional toilet flushes with a fixed volume of water (e.g., 1.0 gpf, 1.6 gpf, etc.). In these toilets, the volume of water is divided between both the rim channel and the sump, such that not all of the water is introduced to the sump. These toilets also generally rely on the introduction of water from the rim during bowl wash-down to supply sufficient water to the trapway to induce the siphon. Because the wash-down water takes a longer path to the bowl, it is delayed relative to the water supplied directly to the sump, reducing the overall power at the beginning of the flush sequence and further delays the formation of the siphon in the trapway.

In the configuration shown in FIG. 11, substantially all of the water in the tank 214 is received directly at the sump 210. The siphon is formed in the trapway 244 substantially exclusively due to the introduction of water through the sump water supply passage 242 and independently from the introduction of water to the rim 206 through the rim supply line 240. Further, in a conventional toilet, such as the toilet 10 shown in FIG. 8, the bowl refills through the rim from the tank as it refills. However, in the toilet 200, the bowl 204 refills from the introduction of water at line pressure directly at the rim 206 and therefore the refill process may be independent from the timing for filling the tank 214.

Figure 12:
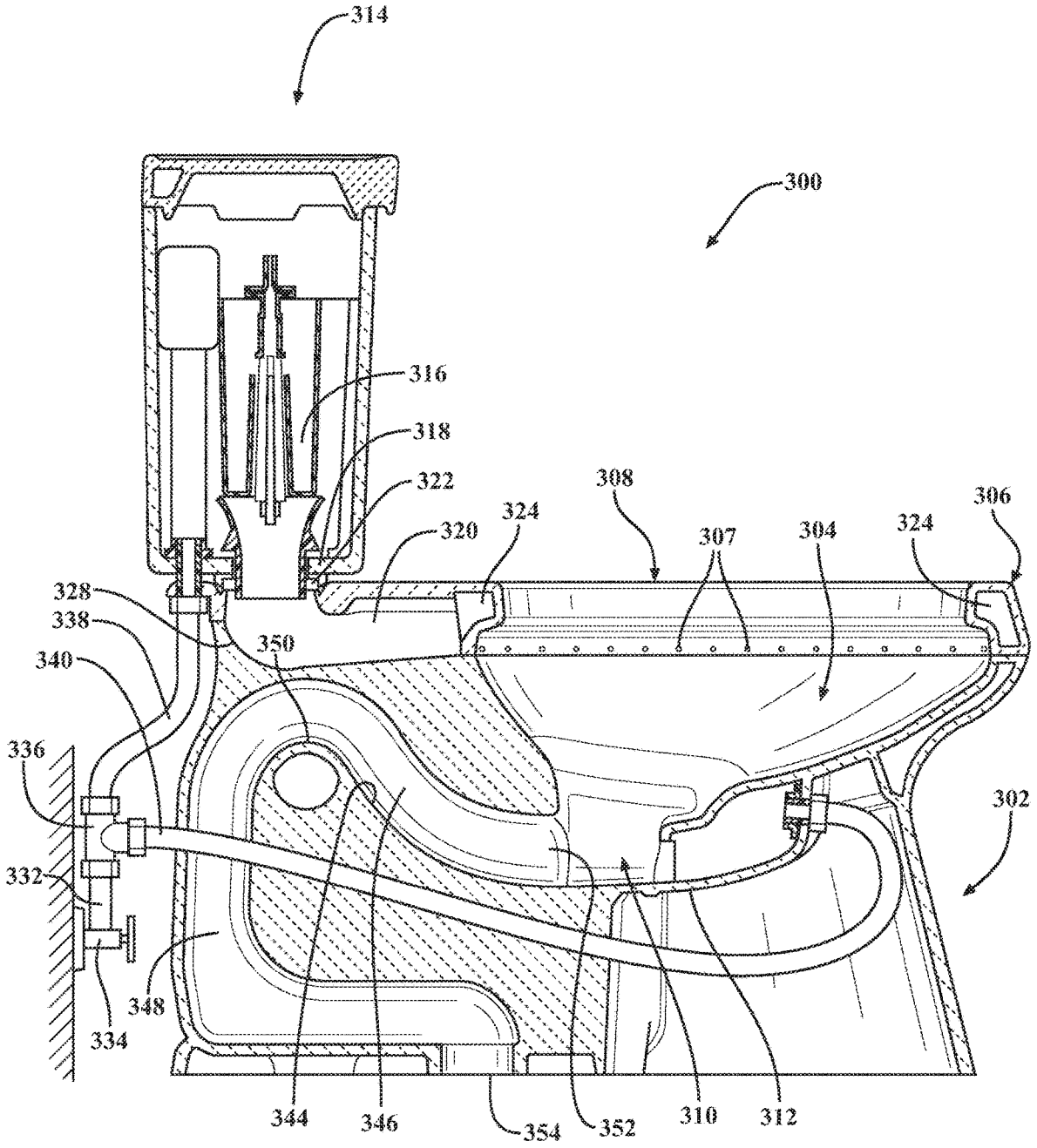
FIG. 12 is a cross-sectional view of a toilet with a hybrid flush engine according to another exemplary embodiment.

FIG. 12 illustrates a toilet 300 with a hybrid flush engine according to another exemplary embodiment. The toilet 300 may be substantially similar and operate in a similar way as the toilet 200 shown in FIG. 11 and discussed above, except as indicated otherwise. The toilet 300 includes a pedestal 302 with a bowl 304 formed therein. The bowl 304 includes a rim 306 at an upper end 308 thereof and a sump 310 at a lower end 312 of the bowl 304. The toilet 300 further includes a tank 314 disposed on the pedestal 302 and a flush valve 316 (i.e., flush canister) disposed in the tank 314 and extending downward through a lower surface 318 of the tank 314 into an inlet passage 320 formed in the pedestal 302. According to another exemplary embodiment, the tank 314 may be located in the bathroom remotely from the pedestal 302 (e.g., concealed within a bathroom wall). During the operation of a flush sequence, the flush valve 316 releases water into the inlet passage 320 through an inlet opening 322 at an upstream end of the inlet passage 320 for flushing the toilet 300.

The pedestal 302 further includes a ring channel 324 formed in the rim 306 and configured to provide water to the bowl 304 through the rim 306 for washing down the sides of the bowl 304 during a flush sequence. Specifically, the rim 306 includes at least one rim outlet 307 formed in the rim 306 and fluidly connecting the rim channel 324 to the bowl 304 for supplying water thereto. According to another exemplary embodiment, the rim 306 includes a plurality of rim outlets 307 formed annularly about the rim 306 for providing water to the bowl 304. The inlet passage 320 is fluidly connected to the rim channel 324, such that when water is introduced through the inlet opening 322 to the inlet passage 320, it first passes through an elbow 328 in the inlet passage 320 and then downstream from the inlet passage 320 directly into the rim channel 324, thereby supplying water to the bowl 304.

A water supply line 332 is fluidly connected to a water source 334 (e.g., a valve, s etc.) in a bathroom and configured to provide pressurized water (e.g., at line pressure of approximately 30 psi) to the toilet 300. A fitting 336 is coupled to a downstream end of the water supply line 332 and is coupled to a tank supply line 338 and a sump supply line 340. The fitting 336 splits (i.e., divides, separates, etc.) the stream of water received in the water supply line 332 from the water source 334 into a tank water supply fed to the tank 314 through the tank supply line 338 and a sump supply fed to the sump 310 through the sump supply line 340. The tank supply line 338 and the sump supply line 340 may be formed from a flexible material and selectively coupled to the tank 314 and the sump 310, respectively. According to another exemplary embodiment, one or both of the tank supply line 338 and the sump supply line 340 may be integrally formed with the toilet 300. For example, the sump supply line 340 may be formed within the pedestal 302 during a vitreous casting process.

The tank supply line 338 is fluidly coupled to the tank 314 and is configured to supply the tank water supply to the tank 314 when the water level in the tank drops below a threshold height, particularly after water is quickly introduced to the rim 306 and into the bowl 304 during wash-down in a flush sequence. The sump supply line 340 is fluidly coupled to (e.g., directly to) the sump 310 and is configured to supply the sump water supply directly to the sump 310 after the activation of the flush sequence. The sump supply line 340 may be mechanically linked to an actuator or the flush valve 316, such that when the flush sequence is activated by the actuator, the sump supply line 340 provides the sump water supply to the sump 310 for generating a siphon in the toilet 300 and removing waste therefrom. For example, the sump supply line 340 may include a valve (not shown), which is coupled either mechanically or electrically to the actuator. The valve may remain open for a set period of timing following the activation of the flush sequence or may close based on a condition in the bowl 304 or in the tank 314.

Referring still to FIG. 12, the toilet 300 includes a trapway 344, including an up-leg 346 extending downstream from the sump 310 and a down-leg 348 extending downstream from the up-leg 346. The trapway 344 forms a weir 350 at a downstream end of the up-leg 346 and an upstream end of the down-leg 348, defining an upper peak in the trapway 344, which is disposed at a height above a trapway inlet 352 at the sump 310, providing a water level in the bowl 304. The down-leg 348 extends downstream from the weir 350 to a trapway outlet 354.

According to an exemplary embodiment, the fitting 336 may control the flow of water in the sump supply line 340. For example, when the flush sequence is activated and the water in the tank 314 is evacuated through the rim channel 324 and into the bowl 304, a pressure in the tank supply line 338 drops. In the configuration shown in FIG. 12, the sump 310 is fluidly separate from a direct connection to the tank 314. Specifically, the tank 314 only communicates with the sump 310 through the rim channel 324 rather than with a separate sump channel. A siphon is formed when water from the sump supply line 340 is introduced to the sump 310 and into the trapway 344 and raises the water level in the up-leg 346 of the trapway 344 above the height of the weir 350. As water pressure increases in a house, the volumetric flow rate from the sump supply line 340 increases, increasing the likelihood that an entire cross-sectional area of the trapway 344 is filled with water, thereby generating a siphon in the trapway 344. Notably, the faster the trapway 344 fills with water, the less overall water will be required from the sump supply line 340. In this configuration, the tank 314 is just used for wash-down purposes, which allows the tank 314 to be reduced in size (e.g., narrower in the longitudinal direction), thereby reducing an overall longitudinal length of the toilet 300.

It should be understood that according to an exemplary embodiment, the toilet 100 of FIGS. 9 and 10 may be combined with one of the hybrid flush engine configurations discussed with respect to FIGS. 11 and 12, such that a rim supply line (e.g., such as the rim supply line 240) is coupled to the rim channel 124 and the tank 114 is coupled to the trapway 160 or a sump supply line (e.g., such as the sump supply line 340) is coupled to the sump 310 and the tank 114 is coupled to the rim channel 124. Further, the toilets 200, 300 shown in FIGS. 11 and 12 can be modified to include the zeta shaped trapways disclosed herein (e.g., the trapways for the toilets 100).

Figure 13:
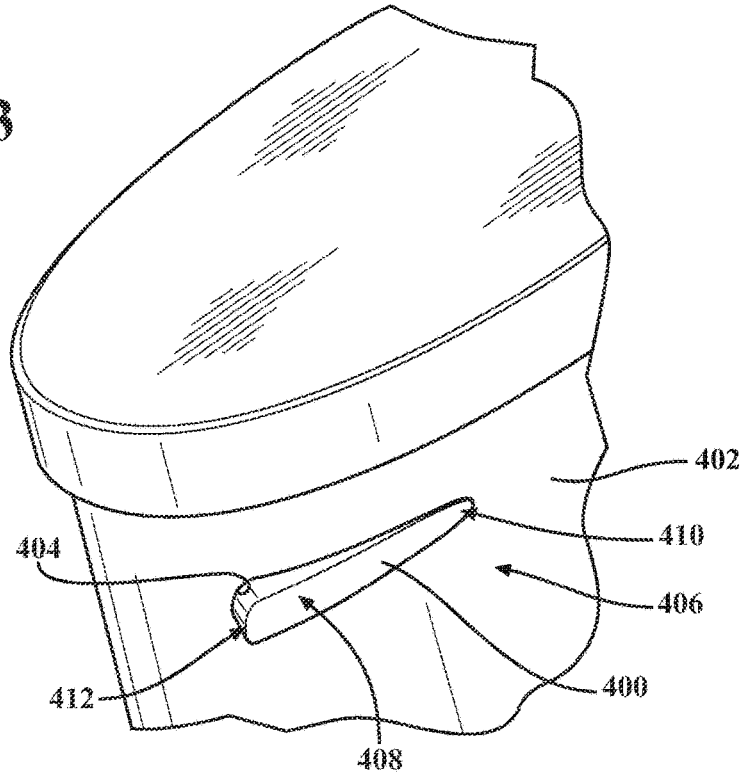
FIG. 13 is a perspective view of a portion of a toilet tank with a flush handle according to an exemplary embodiment.
Figure 14:
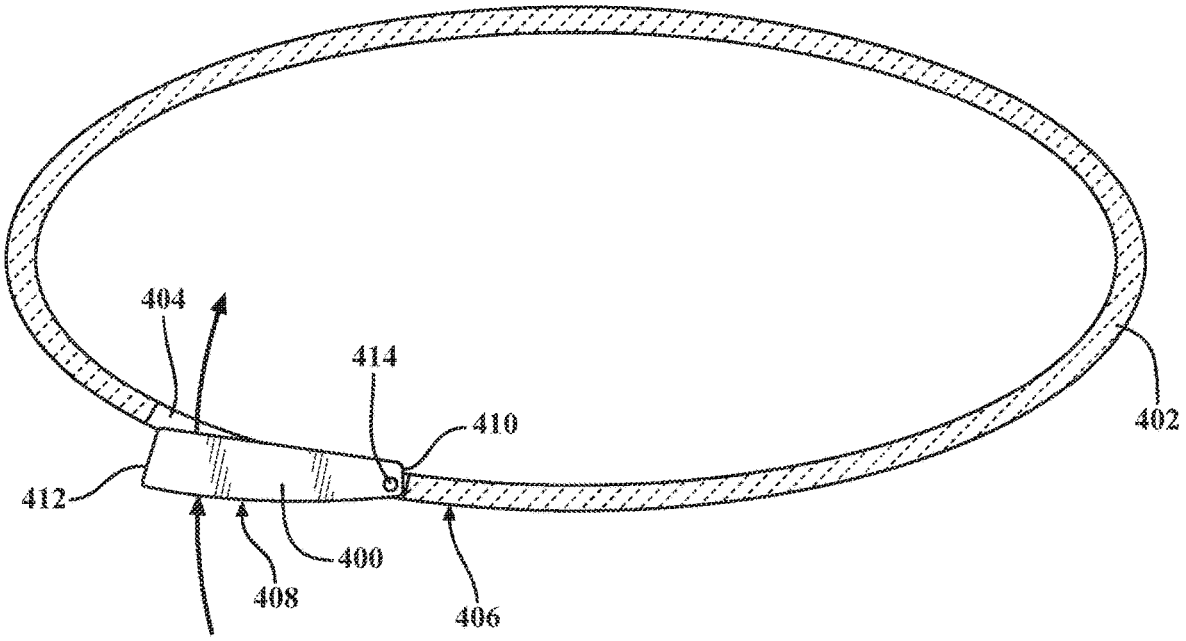
FIG. 14 is a top cross-sectional view of the tank of FIG. 13 with the handle in a first position.
Figure 15:
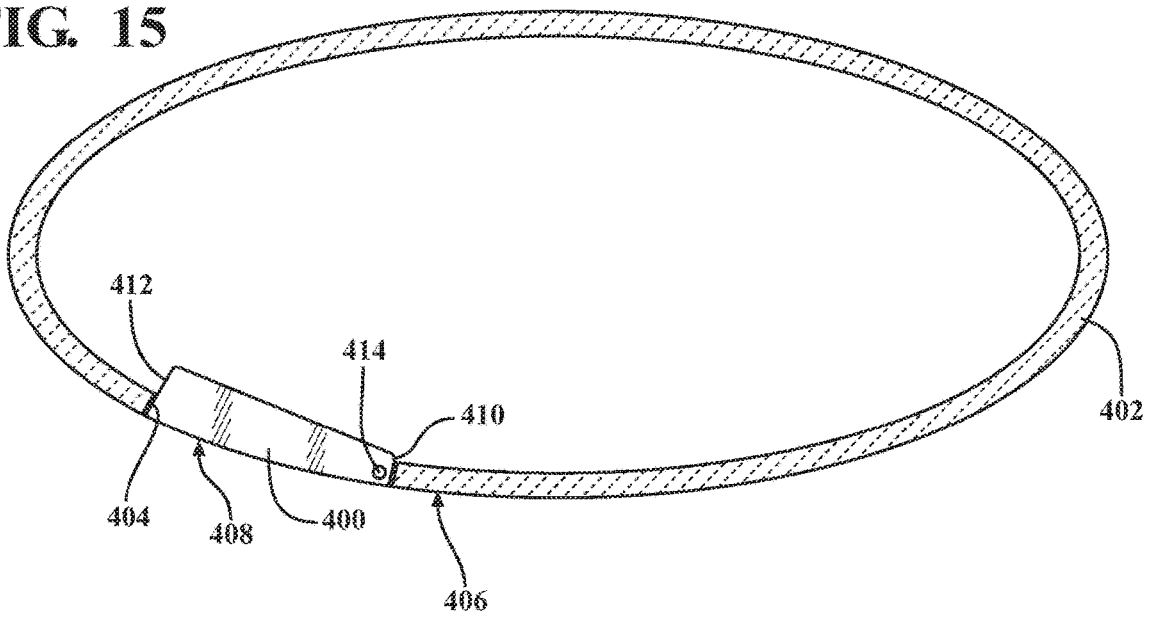
FIG. 15 is a top cross-sectional view of the tank of FIG. 13 with the handle in a second position.

Referring no to FIGS. 13-15, a flush handle 400 for a toilet is shown according to an exemplary embodiment. At least a portion of the flush handle 400 is disposed in a tank 402. Specifically, as shown in FIG. 14, the tank 402 includes a handle opening 404 configured to receive the flush handle 400 therein. The handle opening 404 has a profile, which is substantially the same as an outer profile of the flush handle 400, such that the flush handle 400 is partially or fully received in the handle opening 404. The tank 402 further defines a curved outer surface 406, although according to other exemplary embodiments, the outer surface 406 may be substantially flat proximate the flush handle 400. Similarly, the flush handle 400 defines an outer surface 408 (e.g., a curved outer surface which corresponds to the outer surface 406 of the tank 402.

Referring to FIG. 14, the flush handle 400 defines a first end 410 (i.e., a first lateral end) and an opposing second end 412 (i.e., a second lateral end). A flush handle pivot axis 414 is defined in a substantially vertical direction proximate the first end 410 of the flush handle 400, such that the flush handle 400 is configured to rotate about the pivot axis 414. According to other exemplary embodiments, the pivot axis 414 may be oriented in other directions, such as laterally (i.e., horizontally). In FIG. 14, the flush handle 400 is shown in an extended (e.g., proud, raised, offset, etc.) position, ready to be depressed to activate a flush sequence. In this position, a user of the toilet with the tank 402 is able to depress the second end 412 of the flush handle 400 with a closed fist or other blunt surface, providing ADA compliance for the flush handle 400. When the flush handle 400 is fully depressed into the handle opening 404 in the tank 402, the flush handle 400 pivots about the pivot axis 414 until the second end 412 is fully received within the handle opening 404 and the flush sequence is activated. Notably, as shown in FIG. 15, when the flush handle 400 is fully depressed, the curvature of the outer surface 408 of the flush handle 400 is substantially the same as that of the outer surface 406 of the tank 402, such that the flush handle 400 blends-in to the tank 402 and forms one continuous outer surface, partially concealing the presence of the flush handle 400.

Figure 16:
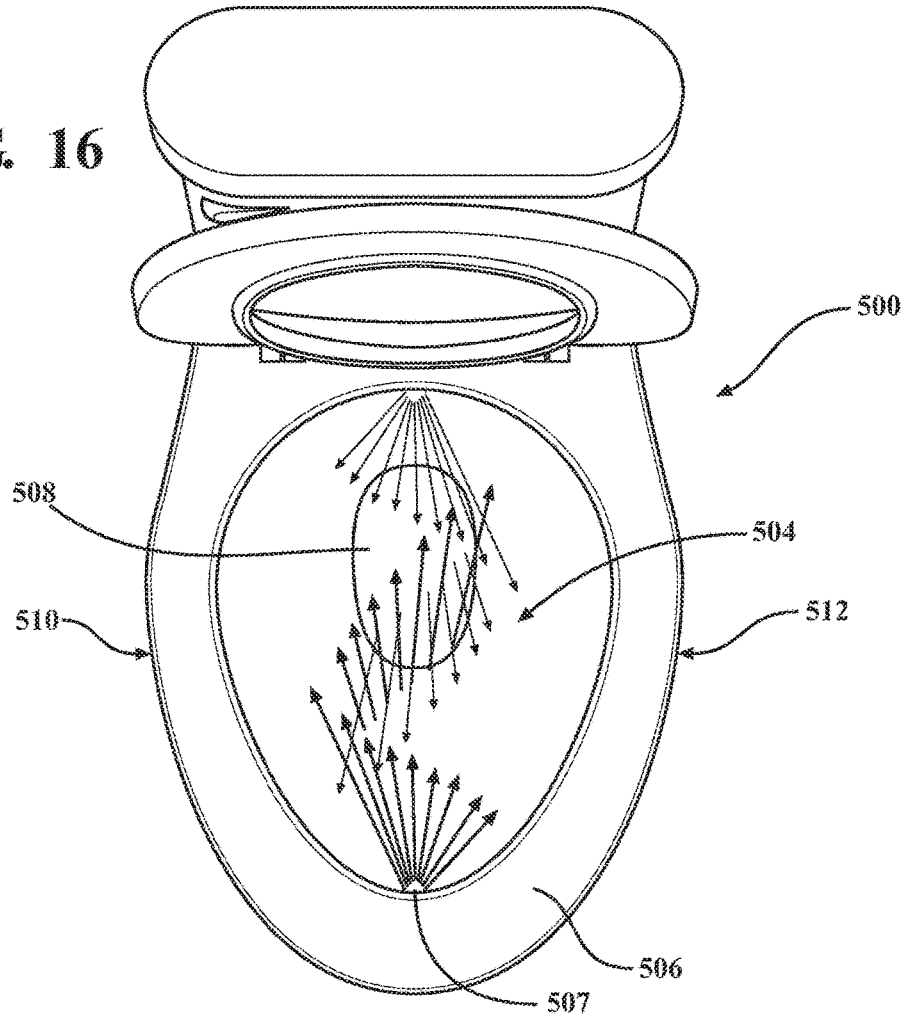
FIG. 16 is a top view of a toilet with rim outlets according to an exemplary embodiment.

Referring now to FIG. 16, a toilet 500 is shown with rim outlets according to various exemplary embodiments. The toilet 500 includes a bowl 504 having a rim 506 formed at an upper end thereof and a sump 508 at a lower end of the bowl 504. For example, the bowl 504 may be substantially similar to the bowls 104, 204, 304 and the rim 506 may be substantially similar to the rims 106, 206, 306 as discussed above. The bowl 504 includes at least one rim outlet 507 (e.g., rim jet, rim opening, etc.) formed in the rim 506 and fluidly connecting a rim channel (not shown) to an interior portion of the bowl 504 for supplying water thereto. The rim outlet 507 can be located in a rear portion of the bowl 504 and/or a front portion of the bowl 504, as shown in FIG. 16. The rim outlet(s) 507 can also be located at one or more side portions of the bowl 504 (alone or in addition to the front and/or rear portions). According to another exemplary embodiment, the rim 506 includes a plurality of rim outlets 507 formed annularly about the rim 506 for providing water to the bowl 504. In this configuration, a plurality of rim outlets 507 may be substantially the same as the rim outlet 507 shown in FIG. 16.

Figure 17:
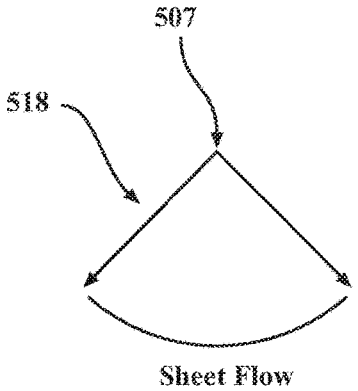
FIG. 17 is a schematic showing an example of a sheet flow pattern.

Referring to the exemplary embodiment shown in FIG. 17, the at least one rim outlet 507 is configured to provide/emit a substantially sheet flow pattern 518. For example, the at least one rim outlet 507 may include a triangular or generally conical shape that expands downstream. The shape of the rim outlet 507 or other structures therein form a triangular sheet, which extends between the first and second sides 510, 512 of the bowl 504 to wash-down a large surface area of the bowl 504 from one or a limited number of rim outlets 507.

Figure 18:
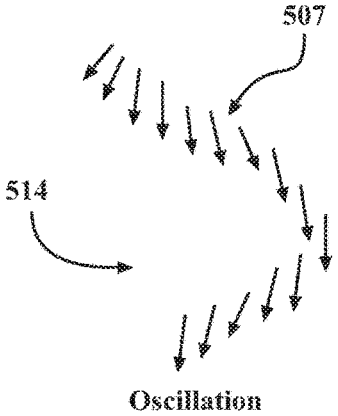
FIG. 18 is a schematic showing an example of an oscillation flow pattern.

According to the exemplary embodiment shown in FIG. 18, the rim outlet 507 defines an oscillating pattern 514 for distributing water into the bowl 504. For example, the rim outlet 507 may have variable directional control over the water output therefrom into the bowl 504. During a flush sequence the rim outlet 507 rotates, redirecting flow from a first side 510 (i.e., a first lateral side) of the bowl 504 to an opposing second side 512 and then back to the first side 510 as part of an oscillation sequence. The oscillation sequence may be configured to increase the surface area of the bowl 504 that is covered with water from a single or limited number of rim outlets 507, reducing the cost and complexity of the toilet 500 relative to other conventional toilets.

Figure 19:
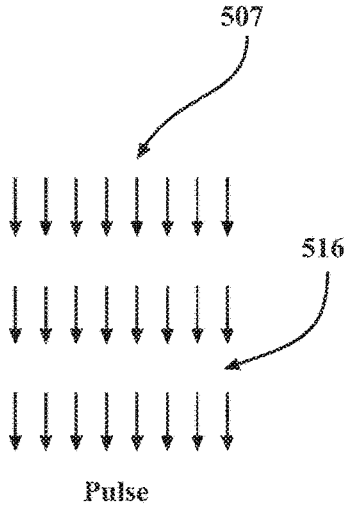
FIG. 19 is a schematic showing an example of a pulse flow pattern.

Referring to the exemplary embodiment shown in FIG. 19, the at least one rim outlet 507 is configured to provide/emit a pulsing sequence flow pattern 516. In this configuration, water is introduced to the bowl 504 through the at least one rim outlet 507 through short pulsations. The repetitive stopping and starting of water flowing through the rim outlet 507 increases the pressure in the water introduced to the bowl 504 through the rim outlet 507, and thereby increases the wash-down cleaning power of the rim outlet 507. Further, the pulsation provides a visual experience for a user to watch.

Figure 20:
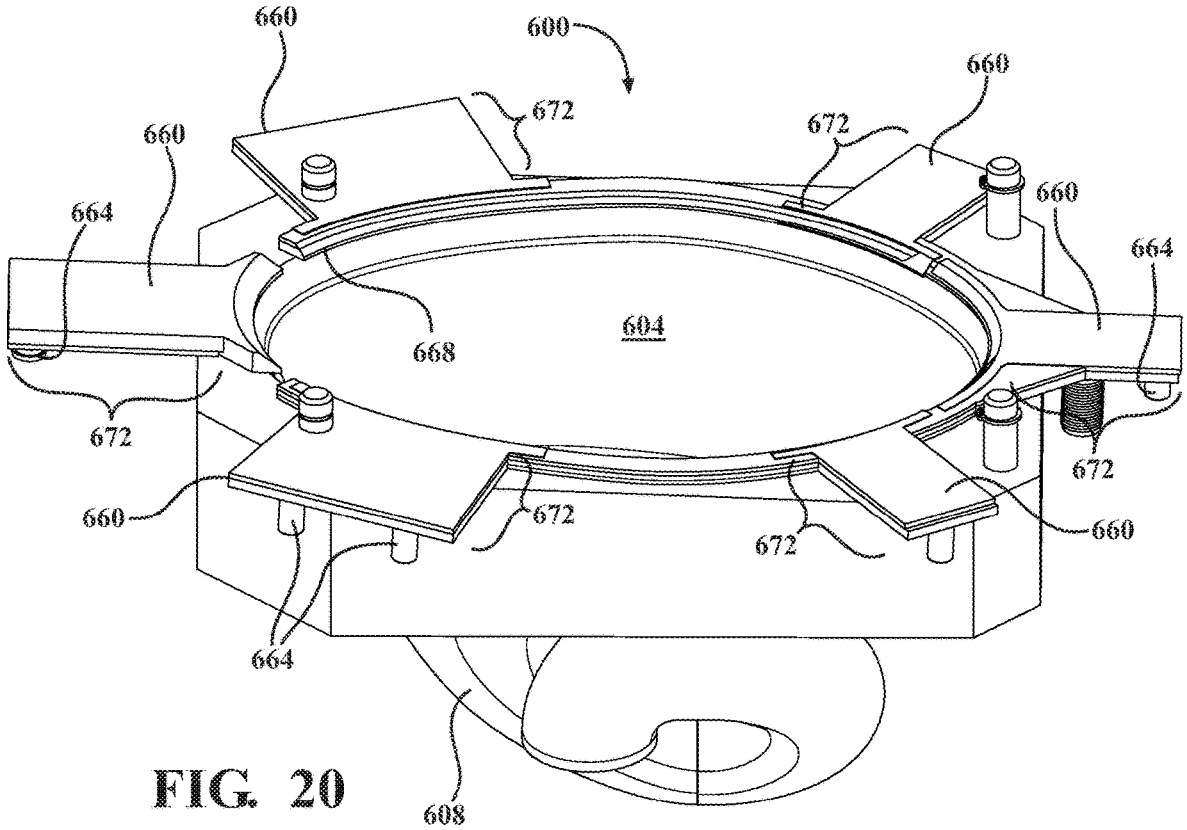
FIG. 20 is a perspective view of a toilet with fluidic devices according to an exemplary embodiment.

FIG. 20 illustrates a portion of a toilet 600 with fluidic devices 660 according to an exemplary embodiment. The toilet 600 includes a bowl 604 and a sump 608 disposed at a lower end of the bowl 604. For example, the bowl 604 may be substantially similar to the bowls 104, 204, 304, and 504 as discussed above. The toilet 600 includes at least one fluidic device 660, which can be cast as part of the toilet 600 and is fluidly connected to at least one water inlet 664. The fluidic device 660 is also fluidly connected to a cover plate 668 (shown in more detail in FIG. 21), which can be cast into the toilet 600 and follows the shape of the bowl 604. The fluidic device 660 houses a channel (not shown) of varying shapes according to different embodiments for fluid to pass through the fluidic device 660 from the water inlet 664 to the cover plate 668 and into the bowl 604. The water inlet 664 is configured to receive water, such as from the refill valve in the toilet 600, so that the bowl 604 can be cleaned during refill. The fluidic device 660, the at least one water inlet 664, and the cover plate 668 together will be referenced to as a fluidic assembly 672. At least one fluidic assembly 672 is located in a position around the bowl 604. According to another exemplary embodiment, the toilet 600 includes a plurality of fluidic assemblies formed at various angular positions around the annular bowl 604 for providing water thereto as shown in FIG. 20. The fluidic assemblies 672 can be positioned at different angles as well as different places around the bowl 604.

Figure 21:
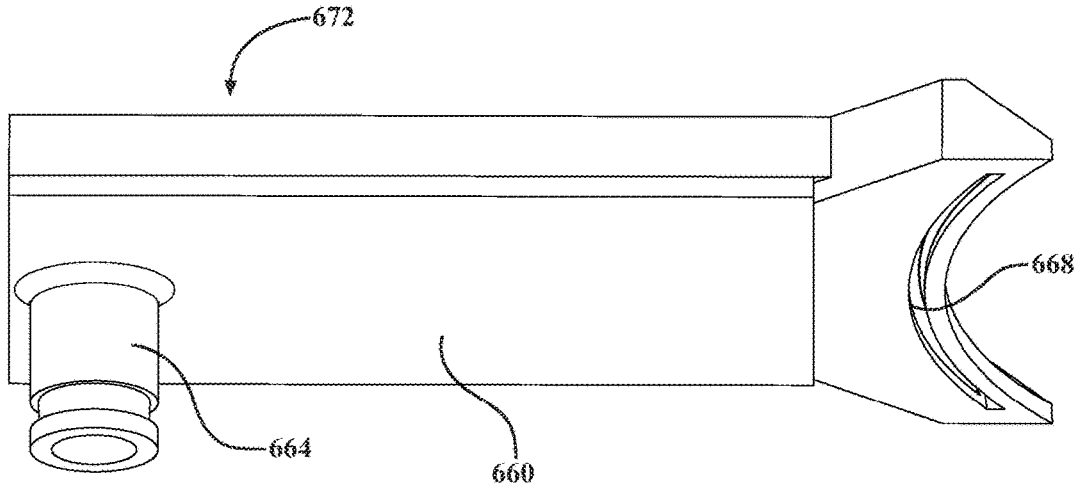
FIG. 21 is a perspective view of a fluidic assembly according to an exemplary embodiment.

Referring now to FIG. 21, the fluidic assembly 672 including the at least one water inlet 664, the fluidic device 660, and the cover plate 668 is shown. The channel (not shown) within the fluidic device 660 is configured to create different oscillating flow patterns depending on the geometry of the channel inside the fluidic device 660. The cover plate 668 includes a slot cast into the toilet 600 that can follow the shape of the bowl 604. The cover plate 668 creates a substantially fan shaped oscillatory flow pattern without using any moving parts. The flow pattern is directed down onto the inside of the bowl 604 when the cover plate 668 receives water from the channel. One or more fluidic assemblies 672 can be positioned at different places and different angles around the bowl 604. Although FIG. 20 shows four fluidic assemblies 672 disposed at different locations around the bowl, a fewer or a greater number of fluidic assemblies 672 can be employed with any toilet disclosed herein. The fluidic assembly 672 can be used in conjunction with any toilet and/or bowl (e.g., 104, 204, 304, 504, and 604) disclosed herein.

Figure 22:
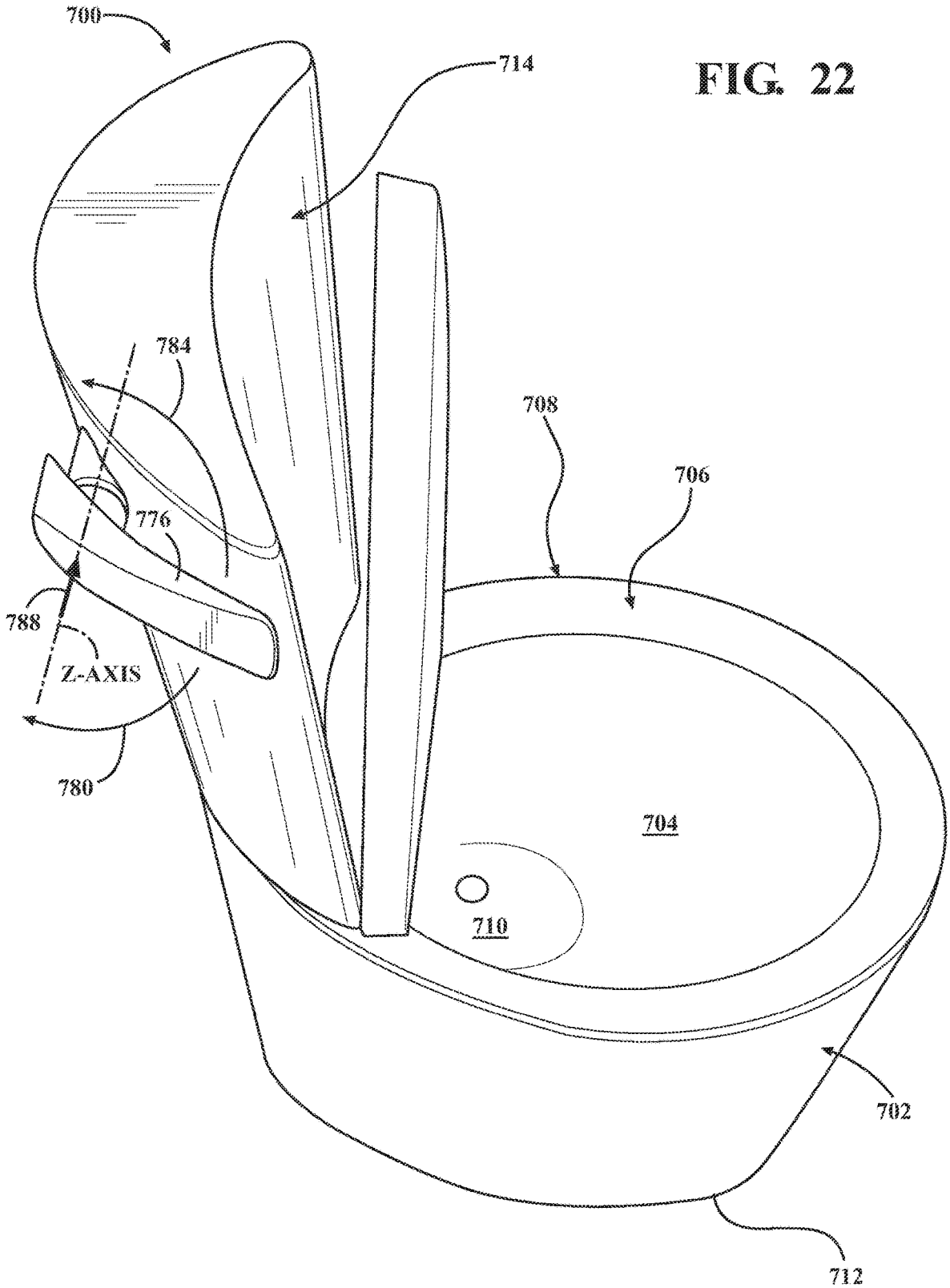
FIG. 22 is a perspective view of a toilet with a multi-flush handle according to an exemplary embodiment.

FIG. 22 shows an exemplary embodiment of a toilet 700 that includes a pedestal 702 with a bowl 704 formed therein. The bowl 704 includes a rim 706 at an upper end 708 thereof and a sump 710 at a lower end 712 of the bowl 704. The toilet 700 further includes a tank 714 disposed above a rear portion of the pedestal 702, and the tank 714 includes a flush handle 776 operatively coupled thereto. The flush handle 776 acts as an actuator to control different flush sequences of the toilet 700. For example, rotation of the flush handle 776 in a clockwise direction 780 around the z-axis causes water to be delivered to both the sump 710 and the rim 706 producing a standard flush sequence (e.g., using a first volume of water). Also for example, rotation of the flush handle 776 in a counterclockwise direction 784 around the z-axis causes a reduced amount of water to be delivered to the sump 710 and the rim 706 as compared to the standard flush sequence creating a half-flush or duel-flush sequence (e.g., using a second volume of water). The second volume of water is less than the first volume of water, according to at least one embodiment. Also for example, applying a force to the flush handle 776 along the z-axis in a direction perpendicular 788 to the flush handle 776 causes water to be delivered only to the rim 706 creating a rinse of the bowl flush sequence. The toilet 700 is configured to provide continuous water flow to the rim 706 by applying a continuous force to the flush handle 776 along the z-axis in a direction substantially perpendicular to the flush handle 776. In another embodiment, the toilet 700 includes an auxiliary tank, which holds a cleaning solution that can be injected to the rim 706 with or without water during a rinse of the bowl flush sequence. This flush handle 776 can be used in conjunction with any of the toilets discussed previously.

Figure 23:
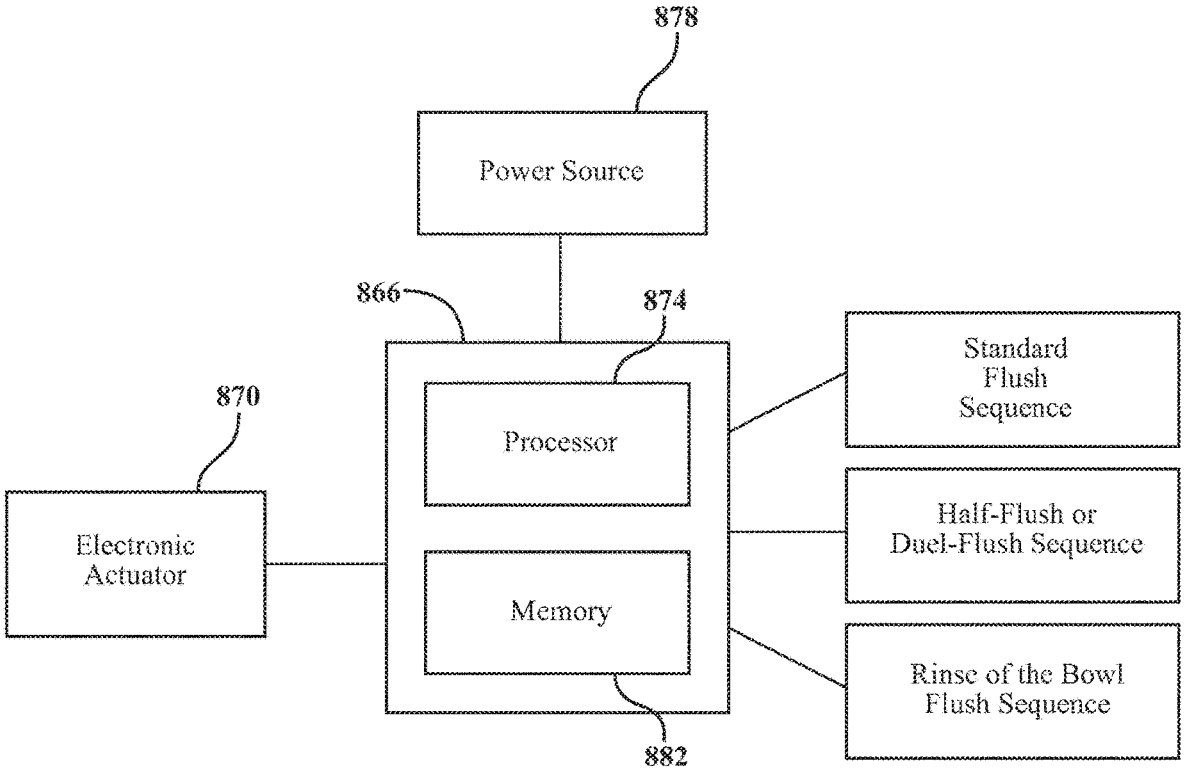
FIG. 23 shows a flow diagram of a control system for a toilet with a multi-flush handle.

FIG. 23 shows a control system 866 for controlling the flush sequences described above. The flush handle 776 can act as the actuator 870 of the system. Other types of electronic and/or mechanical actuators 870 can be used, such as buttons, switches, applications on smart devices (e.g., phones). The actuator 870 can be coupled to an electronic valve to control different flow paths, those of which are mentioned above. A processor 874, which electrically connects to a power source 878, then decides which flush sequence, from those described above, to execute, such as in response to the input (e.g., type of activation) into the actuator 870. The executed flush sequence is stored in a memory 882 and the control system 866 is available to receive a new signal.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the application as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present application.

We claim:

1. A toilet comprising:

a bowl having a sump in a bottom thereof;

a trapway fluidly connecting the sump to an outlet of the toilet, wherein the trapway has a zeta shape and is configured to induce a siphon to provide a pressure to suction waste water from the bowl during a flush cycle; and a trapway supply conduit fluidly connected to the trapway in an orientation such that a line of the trapway supply conduit is tangent within an angle range to a line of an upleg region of the trapway and the trapway supply conduit is configured to supply water to the trapway that follows a contour of an inner surface of the trapway supply conduit and continues into the upleg region of the trapway by relying on a fluid flow to follow a curve of a convex surface placed proximate to the fluid flow; and wherein the upleg region of the trapway is defined by a first region that extends outwardly away from the sump, a second region that curves upwardly from the first region toward the bowl, and a third region that loops partially around from the second region back toward the sump and downward along a side of the first region.

2. The toilet of claim 1, further comprising:

a rim jet coupled to the bowl, wherein the rim jet is configured to provide a flow of water in a sheet-like layer substantially tangent to an inner surface of the bowl.

3. A toilet comprising:

a bowl having a sump in a bottom thereof;

a trapway fluidly connecting the sump to an outlet of the toilet, wherein the trapway has a zeta shape and is configured to induce a siphon to provide a pressure to suction waste water from the bowl during a flush cycle;

a trapway supply conduit fluidly connected to the trapway in an orientation such that a line of the trapway supply conduit is tangent within an angle range to a line of an upleg region of the trapway and the trapway supply conduit is configured to supply water to the trapway that follows a contour of an inner surface of the trapway supply conduit and continues into the upleg region of the trapway by relying on a fluid flow to follow a curve of a convex surface placed proximate to the fluid flow; and a trapway valve configured to control a flow of water from a main supply conduit to the trapway supply conduit; and a sump valve configured to control the flow of water from the main supply conduit to a sump supply conduit.

4. The toilet of claim 1, wherein the trapway comprises a first region that extends from the sump and a second region that curves upward from the first region.

5. The toilet of claim 4, wherein the trapway comprises a third region that is curved and extends from the second region.

6. A tankless toilet comprising:

a bowl having a sump in a bottom thereof;

a trapway fluidly connecting the sump to an outlet of the tankless toilet, wherein the trapway has a zeta shape and is configured to induce a siphon to provide a pressure to suction waste water from the bowl during a flush cycle; and a trapway supply conduit fluidly connected to the trapway in an orientation such that a line of the trapway supply conduit is tangent to a line of an upleg region of the trapway within ±15° and the trapway supply conduit is configured to supply water to the trapway that follows a contour of an inner surface of the trapway supply conduit and continues in the same direction within ±15° into the upleg region of the trapway by relying on a fluid flow to follow a curve of a convex surface placed proximate to the fluid flow, wherein the upleg region of the trapway is defined by a first region that extends outwardly away from the sump, a second region that curves upwardly from the first region toward the bowl, and a third region that loops partially around from the second region back toward the sump and downward along a side of the first region.

7. The tankless toilet of claim 6, further comprising a rim jet coupled to the bowl, wherein the rim jet is configured to provide a flow of water in a sheet-like layer substantially tangent to an inner surface of the bowl.

8. The tankless toilet of claim 6, further comprising:

a trapway valve configured to control a flow of water from a main supply conduit to the trapway supply conduit; and a sump valve configured to control the flow of water from the main supply conduit to a sump supply conduit.

9. The tankless toilet of claim 8, wherein only the trapway valve is opened to prime the siphon in the trapway when the bowl includes only liquids disposed therein, and wherein the trapway valve and the sump valve are both operated when the bowl includes solid materials.

10. The tankless toilet of claim 6, further comprising a multi-port valve configured to control water flow to each of the trapway supply conduit, a sump supply conduit, and a rim supply conduit; wherein the multi-port valve is configured to open and close after predetermined time intervals to selectively direct water to each of the trapway, the sump, and a rim, respectively, so as to prime the trapway.

11. The tankless toilet of claim 6, wherein the line of the trapway supply conduit is a centerline that is tangent to a centerline of the upleg region of the trapway within ±10°, and wherein the trapway supply conduit is configured to supply water to the trapway that follows the contour of the inner surface of the trapway supply conduit and continues in the same direction within ±10° into the upleg region of the trapway by relying on the fluid flow to follow the curve of the convex surface placed proximate to the fluid flow.

12. A trapway system comprising:

a trapway fluidly connecting a sump to an outlet of a toilet, wherein the trapway has a zeta shape and is configured to induce a siphon to provide a pressure to suction waste water from a bowl during a flush cycle;

a trapway supply conduit fluidly connected to the trapway in an orientation such that a line of the trapway supply conduit is tangent within an angle range to a line of an upleg region of the trapway and the trapway supply conduit is configured to supply water to the trapway that follows a contour of an inner surface of the trapway supply conduit and continues into the upleg region of the trapway by relying on a fluid flow to follow a curve of a convex surface placed proximate to the fluid flow; and a trapway valve configured to control a flow of water from a main supply conduit to the trapway supply conduit; and a sump valve configured to control the flow of water from the main supply conduit to a sump supply conduit.

13. The trapway system of claim 12, wherein the upleg region of the trapway is defined by a first region that extends outwardly away from the sump, a second region that curves upwardly from the first region toward the bowl, and a third region that loops partially around from the second region back toward the sump and downward along a side of the first region.

14. The trapway system of claim 12, wherein the trapway comprises a first region that extends from the sump and a second region that curves upward from the first region.

15. The trapway system of claim 14, wherein the trapway comprises a third region that is curved and extends from the second region.

16. The tankless toilet of claim 6, further comprising:

a trapway valve configured to control a flow of water from a main supply conduit to the trapway supply conduit.

17. The tankless toilet of claim 6, further comprising:

a sump valve configured to control the flow of water from a main supply conduit to a sump supply conduit.

18. The toilet of claim 3, wherein the trapway comprises a first region that extends from the sump and a second region that curves upward from the first region.

19. The toilet of claim 18, wherein the trapway comprises a third region that is curved and extends from the second region.

20. The toilet of claim 3, further comprising:

a rim jet coupled to the bowl.

* * * * *